US008015001B2

(12) United States Patent
Suzuki

(10) Patent No.: US 8,015,001 B2
(45) Date of Patent: Sep. 6, 2011

(54) SIGNAL ENCODING APPARATUS AND METHOD THEREOF, AND SIGNAL DECODING APPARATUS AND METHOD THEREOF

(75) Inventor: Shiro Suzuki, Kanagawa (JP)

(73) Assignee: Sony Corporation, Tokyo (JP)

( * ) Notice: Subject to any disclaimer, the term of this patent is extended or adjusted under 35 U.S.C. 154(b) by 1285 days.

(21) Appl. No.: 11/571,328

(22) PCT Filed: May 31, 2005

(86) PCT No.: PCT/JP2005/009939

§ 371 (c)(1),
(2), (4) Date: Dec. 27, 2006

(87) PCT Pub. No.: WO2006/001159

PCT Pub. Date: Jan. 5, 2006

(65) Prior Publication Data

US 2008/0015855 A1 Jan. 17, 2008

(30) Foreign Application Priority Data

Jun. 28, 2004 (JP) ..... P2004-190249

(51) Int. Cl.
*G10L 19/14* (2006.01)
*G10L 21/00* (2006.01)

(52) U.S. Cl. ..... 704/225; 704/226; 704/229; 704/503; 704/504

(58) Field of Classification Search ..... 704/225, 704/226, 229
See application file for complete search history.

(56) References Cited

U.S. PATENT DOCUMENTS

| | | | | |
|---|---|---|---|---|
| 5,353,375 | A | 10/1994 | Goto et al. | |
| 2002/0054646 | A1 | 5/2002 | Tsushima et al. | |
| 2004/0196770 | A1* | 10/2004 | Touyama et al. | 369/59.11 |
| 2005/0267744 | A1 | 12/2005 | Nettre et al. | |

FOREIGN PATENT DOCUMENTS

| | | | |
|---|---|---|---|
| EP | 0825725 | A | 2/1998 |
| EP | 1396841 | A | 3/2004 |
| JP | 6-291671 | | 10/1994 |
| JP | 7-44192 | | 2/1995 |

(Continued)

OTHER PUBLICATIONS

European Search Report issued on Feb. 28, 2008 in connection with EP Patent No. 05745896.0.

(Continued)

*Primary Examiner* — Justin Rider
(74) *Attorney, Agent, or Firm* — SNR Denton US LLP

(57) ABSTRACT

In a signal encoding apparatus (1) a frequency normalization unit (11) normalizes each spectrum of spectral signals by using respectively normalization factors and supplies a normalization factor index per spectrum to a quantization accuracy determining unit (13). The quantization accuracy determining unit (13) adds a weighting factor using auditory properties to the normalization factor index per spectrum of range conversion spectral signals which are subjected to normalization as well as range conversion, and the quantization accuracy is determined according to the result of addition. Then, a quantization unit (14) performs quantization with the quantization accuracy corresponding to a quantization accuracy index supplied from the quantization accuracy determining unit (13), while the encoding/code string generating unit (15) encodes the weighting factor supplied from the quantization accuracy determining unit (13), together with the normalization factor index and the quantized spectral signal.

15 Claims, 17 Drawing Sheets

FOREIGN PATENT DOCUMENTS

| | | |
|---|---|---|
| JP | 8-129400 | 5/1996 |
| JP | 9-500503 | 1/1997 |
| JP | 10-240297 | 9/1998 |
| JP | 2001-306095 | 11/2001 |
| JP | 2002-158589 | 5/2002 |
| JP | 2002-221997 | 8/2002 |
| JP | 2003-323198 | 11/2003 |
| WO | 95/02930 | 1/1995 |
| WO | WO9944291 | 9/1999 |
| WO | WO 03096325 A1 * | 11/2003 |

OTHER PUBLICATIONS

Rainer Zelinski and Peter Noll; Adaptive Transform Coding of Speech Signals; IEEE Transactions on Acoustics, Speech, and Signal Processing; vol. ASSP-25, No. 4; Aug. 1977.

International Search Report dated Sep. 6, 2005.

Japanese Patent Office Action corresponding to Japanese Serial No. 2004-190249 dated Aug. 3, 2010.

* cited by examiner

SIGNAL ENCODING APPARATUS AND METHOD THEREOF, AND SIGNAL DECODING APPARATUS AND METHOD THEREOF

TECHNICAL FIELD

The present invention relates to a signal encoding apparatus and a method thereof for encoding an inputted digital audio signal by so-called transform coding and outputting an acquired code string, and a signal decoding apparatus and a method thereof for decoding the code string and restoring the original audio signal.

The present application claims priority of Japanese Patent Application No. 2004-190249 filed Jun. 28, 2004, which is hereby incorporated by reference.

BACKGROUND ART

A number of conventional encoding methods of audio signals such as voice and music are known. As one such example, a so-called transform coding method which converts a time-domain audio signal into a frequency-domain spectral signal (spectral transformation) can be cited.

As the above-mentioned spectral transformation, for example, there is a method of converting the audio signal of the time domain into the spectral signal of the frequency domain by blocking the inputted audio signal for each preset unit time (frame) and carrying out Discrete Fourier Transformation (DFT), Discrete Cosine Transformation (DCT) or Modified DCT (MDCT) for each block.

Further, when encoding the spectral signal generated by the spectral transformation, there is a method of dividing the spectral signal into frequency domains of a preset width and quantizing and coding after normalizing for each frequency band. A width of each frequency band when performing frequency band division may be determined by taking human auditory properties into consideration. Specifically, there is a case of dividing the spectral signal into a plurality of (for example, 24 or 32) frequency bands by a band division width called the critical band which grows wider as the band becomes higher. Furthermore, encoding may be carried out by conducting adaptable bit allocation per frequency band. For a bit allocation technique, there may be cited the technique listed in "*IEEE Transactions of Acoustics, Speech, and Signal Processing*, Vol. ASSP-25, No. 4, August 1977" (hereinafter referred to as Document 1).

In the Document 1, bit allocation is conducted in terms of the size of each frequency component per frequency band. In this technique, a quantization noise spectrum becomes flat and noise energy becomes minimum. However, since a masking effect and an isosensitivity curve are not taken into consideration aurally, an actual noise level is not minimum.

Further, in the Document 1, a concept of the critical band is utilized and quantization is made collectively by the higher-the-wider band division width, and hence, as compared to the low band, there is a problem of deteriorating information efficiency in securing quantization accuracy. Moreover, to solve this problem, there is a need of an additional function such as a method of separating and extracting only a specified frequency component from one frequency band and a method of separating and extracting a large frequency component in a preset time domain.

DISCLOSURE OF THE INVENTION

Problems to be Solved by the Invention

The present invention has been proposed in view of such conventional circumstances. An object of the present invention is to provide a signal encoding apparatus and a method thereof for encoding an audio signal so as to minimize a noise level at the time of reproduction without dividing into the critical band, and a signal decoding apparatus and a method thereof for decoding the code string to restore the original audio signal.

To accomplish the above-mentioned object, a signal encoding apparatus according to the present invention includes: a spectral transformation means for transforming an inputted time-domain audio signal into a frequency-domain spectral signal for each preset unit time; a normalization means for selecting any of a plurality of normalization factors having a preset step width with respect to each spectral signal mentioned above and normalizing the spectral signal by using the selected normalization factor to generate a normalized spectral signal; a quantization accuracy determining means for adding a weighting factor per spectral signal with respect to a normalization factor index used for the normalization and determining the quantization accuracy of each normalized spectral signal based on the result of addition; a quantization means for quantizing each normalized spectral signal mentioned above according to the quantization accuracy to generate a quantized spectral signal; and an encoding means for generating a code string by at least encoding the quantized spectral signal, the normalization factor index and weight information relating to the weighting factor.

The quantization accuracy determining means determines the weighting factor based on the characteristics of the audio signal or the spectral signal.

Further, a signal encoding method according to the present invention includes: a spectral transformation step of transforming an inputted time-domain audio signal into a frequency-domain spectral signal for each preset unit time; a normalization step of selecting any of a plurality of normalization factors having a preset step width with respect to each spectral signal mentioned above and normalizing the spectral signal by using the selected normalization factor to generate the normalized spectral signal; a quantization accuracy determining step of adding a weighting factor per spectral signal with respect to the normalization factor index used for the normalization and determining the quantization accuracy of each normalized spectral signal based on the result of addition; a quantization step of quantizing each normalized spectral signal mentioned above according to the quantization accuracy to generate a quantized spectral signal; and an encoding step of generating a code string by at least encoding the quantized spectral signal, the normalization factor index and weight information relating to the weighting factor.

Further, a signal decoding apparatus according to the present invention which decodes the code string generated by the signal encoding apparatus and the method thereof and restores the audio signal, includes: a decoding means for at least decoding the quantized spectral signal, the normalization factor index and the weight information; a quantization accuracy restoring means for adding a weighting factor determined from the weight information per spectral signal with respect to the normalization factor index and restoring the quantization accuracy of each normalized spectral signal based on the result of addition; an inverse quantization means for restoring the normalized spectral signal by inversely quantizing the quantized spectral signal according to the quantization accuracy of each normalized spectral signal; an inverse normalization means for restoring the spectral signal by inversely normalizing each normalized spectral signal mentioned above by using the normalization factor; and an inverse spectral conversion means for restoring the audio signal for each preset unit time by converting the spectral signal.

Further, a signal decoding method according to the present invention which restores the audio signal by decoding the code string generated likewise by the signal encoding apparatus and the method thereof, includes: a decoding step of at least decoding the quantized spectral signal, the normalization factor index and the weight information; a quantization accuracy restoring step of adding a weighting factor determined from the weight information per spectral signal with respect to the normalization factor index and restoring the quantization accuracy of each normalized spectral signal based on the result of addition; an inverse quantization step of restoring the normalized spectral signal by inversely quantizing the quantized spectral signal according to the quantization accuracy of each normalized spectral signal; an inverse normalization step of restoring the spectral signal by inversely normalizing each normalized spectral signal mentioned above by using the normalization factor; and an inverse spectral conversion step of restoring an audio signal for each preset unit time by converting the spectral signal.

Further, a signal decoding method according to the present invention which restores the time-domain audio signal by decoding the inputted code string, includes: a decoding step of at least decoding the quantized spectral signal, the normalization factor index and the weight information; a quantization accuracy restoring step of adding a weighting factor determined from the weight information per spectral signal with respect to the normalization factor index and restoring the quantization accuracy of each normalized spectral signal based on the result of addition; an inverse quantization step of restoring the normalized spectral signal by inversely quantizing the quantized spectral signal according to the quantization accuracy of each normalized spectral signal mentioned above; an inverse normalization step of restoring the spectral signal by inversely normalizing each normalized spectral signal mentioned above by using the normalization factor; and an inverse spectral conversion step of restoring the audio signal for each preset unit time by converting the spectral signal.

Other objects and advantages of the present invention will become more apparent from the description of the embodiments in the following.

BEST MODE FOR CARRYING OUT THE INVENTION

Embodiments to which the present invention has been applied will be described in detail below with reference to the drawings. This embodiment is an application of the present invention to a signal encoding apparatus and a method thereof for encoding an inputted digital audio signal by means of so-called transform coding and outputting an acquired code string, and a signal decoding apparatus and a method thereof for restoring the original audio signal by decoding the code string.

Figure 1:
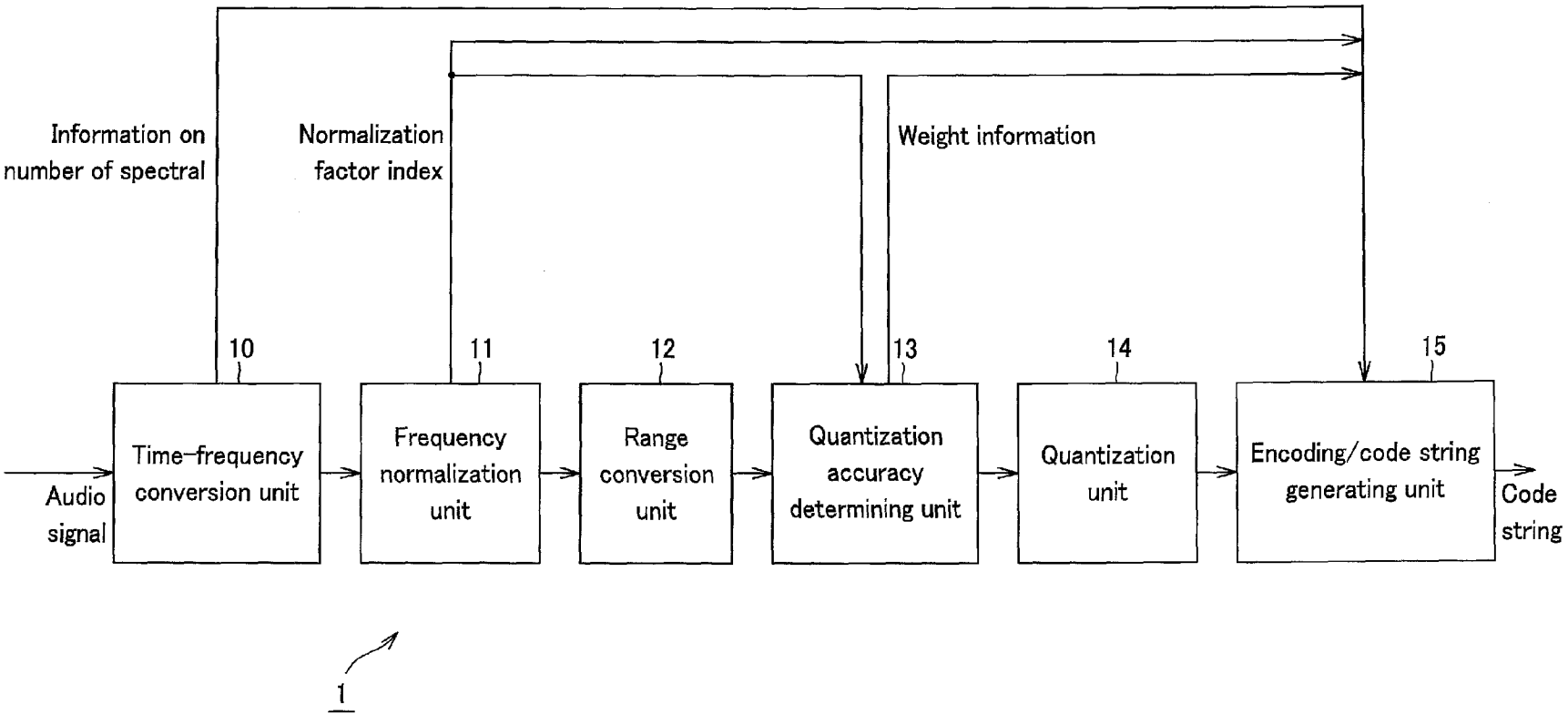
FIG. 1 is diagram showing a schematic construction of a signal encoding apparatus according to an embodiment.

First, a schematic structure of a signal encoding apparatus according to the embodiment will be shown in FIG. 1. Further, a procedure of encoding processing in a signal encoding apparatus 1 illustrated in FIG. 1 will be shown in a flowchart in FIG. 2. The flowchart in FIG. 2 will be described with reference to FIG. 1.

Figure 2:
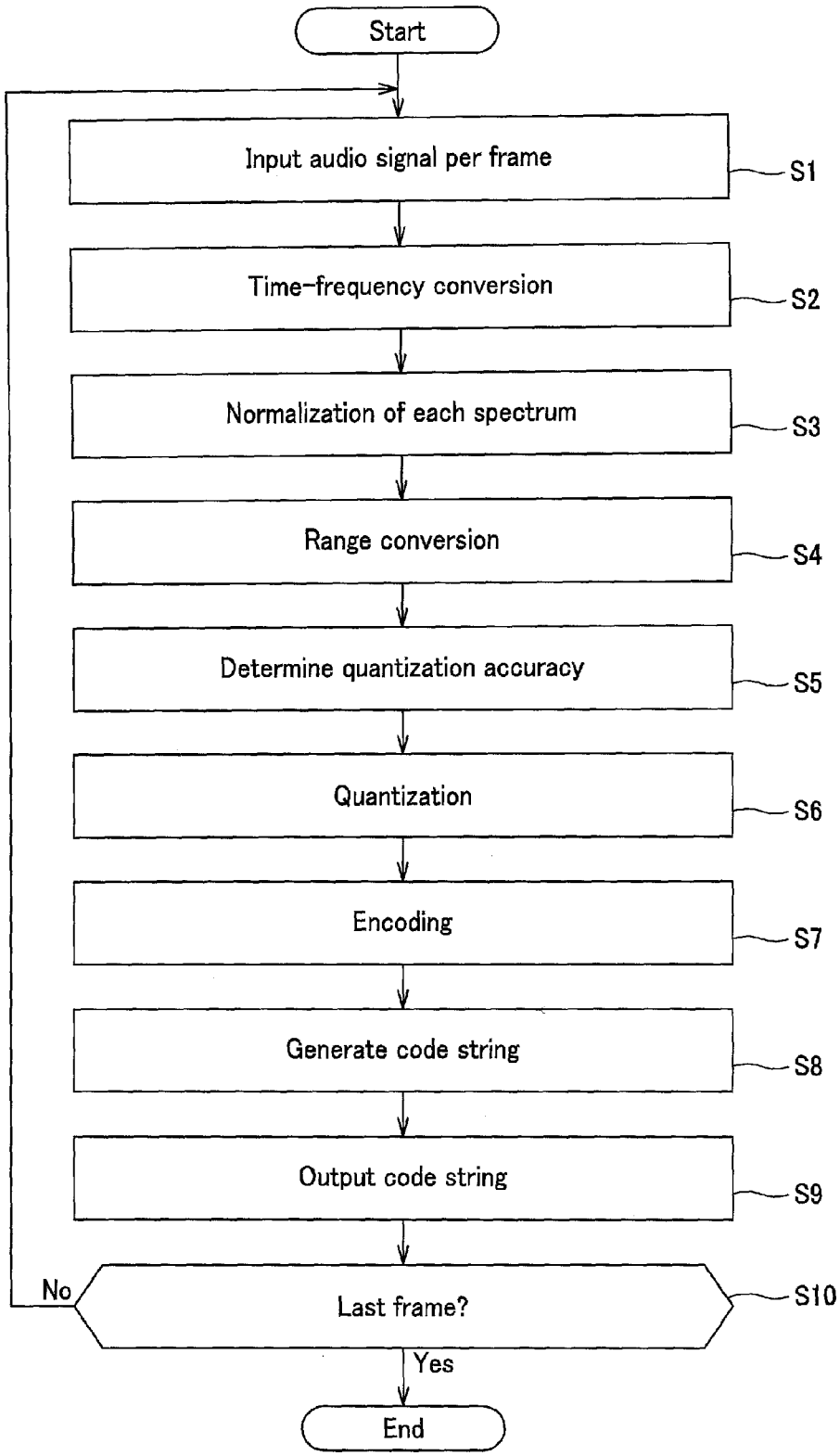
FIG. 2 is a flowchart explaining a procedure of encoding processing in the signal encoding apparatus.
Figure 3A:
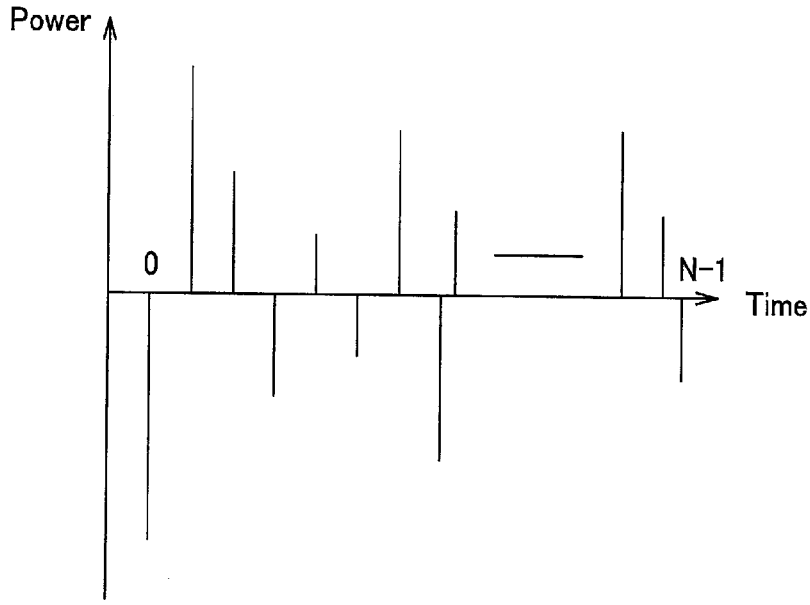
FIG. 3A and FIG. 3B are diagrams to explain time-frequency conversion processing in a time-frequency conversion unit of the signal encoding apparatus.
Figure 3B:
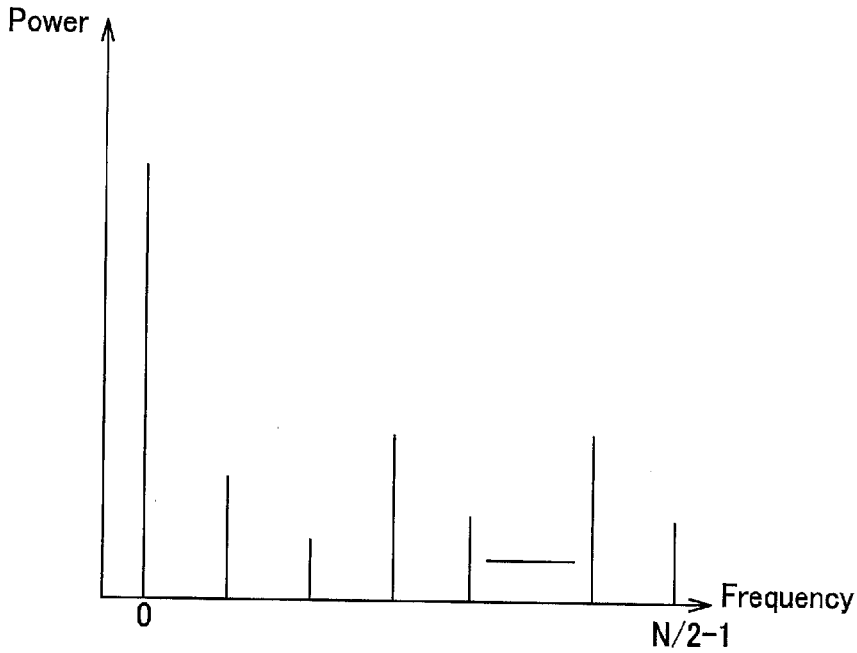

In step S1 of FIG. 2, a time-frequency conversion unit 10 inputs an audio signal [PCM(Pulse Code Modulation) data and the like] per preset unit time (frame), while in step S2, this audio signal is converted to a spectral signal through MDCT (Modified Discrete Cosine Transformation). As a result, an N number of audio signals shown in FIG. 3A are converted to the N/2 number of MDCT spectra (absolute value shown) shown in FIG. 3B. The time-frequency conversion unit 10 supplies the spectral signal to a frequency normalization unit 11, while supplying information on the number of spectra to an encoding/code string generating unit 15.

Figure 4:
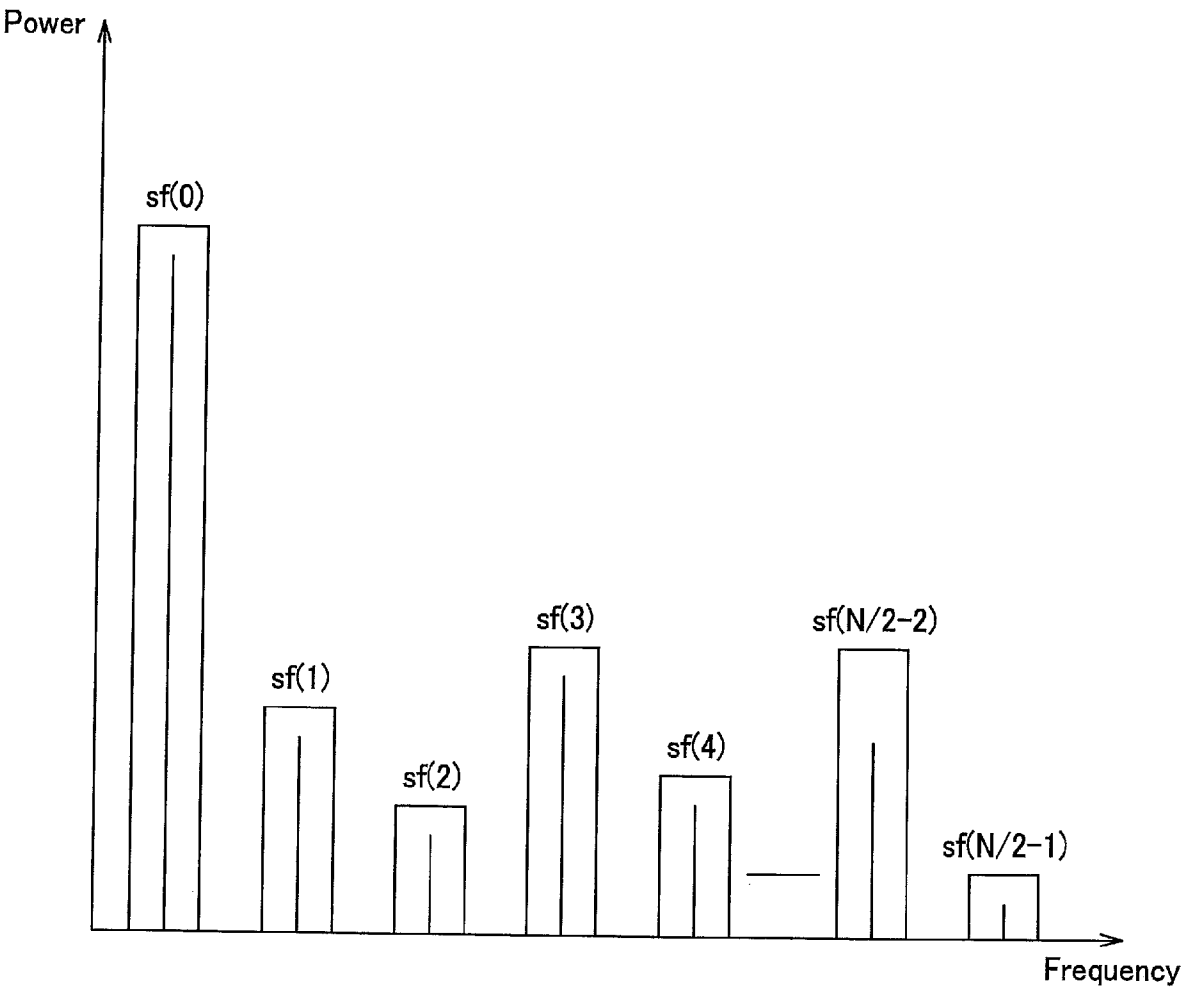
FIG. 4 is a diagram to explain normalization processing in a frequency normalization unit of the signal encoding apparatus.

Next, in step S3, the frequency normalization unit 11 normalizes, as shown in FIG. 4, each spectrum of N/2 respectively by the normalization coefficients sf(0), . . . , sf(N/2-1), and generates normalized spectral signals. The normalization factors sf are herein supposed to have 6 dB by 6 dB, that is, a step width of double at a time. In normalization, by using a normalization factor whose value is one step larger than each spectral value, the range of normalization spectra can be concentrated on the range from ±0.5 to ±1.0. The frequency normalization unit 11 converts the normalization factor sf per normalized spectrum, to the normalization factor index idsf, for example, as shown in Table 1 below, supplies the normalized spectral signal to the range conversion unit 12, and, at the same time, supplies the normalization factor index idsf per normalized spectram to the quantization accuracy determining unit 13 and the encoding/code string generating unit 15.

TABLE 1

| | | | | | | | | | | | | |
|---|---|---|---|---|---|---|---|---|---|---|---|---|
| sf | 65536 | 32768 | 16384 | 8192 | 4096 | . . . | 4 | 2 | 1 | ½ | . . . | 1/32768 |
| idsf | 31 | 30 | 29 | 28 | 27 | . . . | 17 | 16 | 15 | 14 | . . . | 0 |

Figure 5:
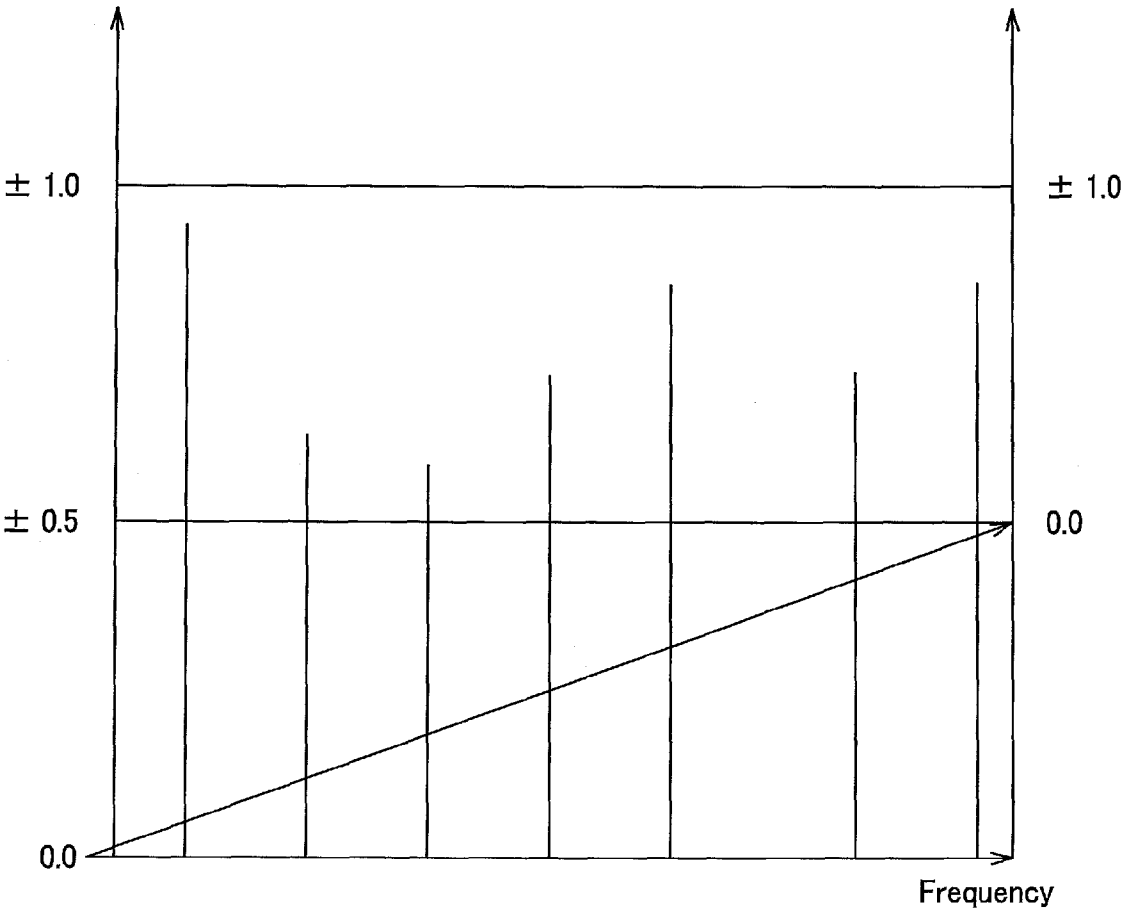
FIG. 5 is a diagram to explain range conversion processing in a range conversion unit of the signal encoding apparatus.

Subsequently, in step S4, as the left longitudinal axis shows in FIG. 5, the range conversion unit 12 regards normalized spectral values concentrated in the range from ±0.5 to ±1.0 and considers a position of ±0.5 therein as 0.0, and then, as shown in the right longitudinal axis, performs a range conversion in the range from 0.0 to ±1.0. In the signal encoding apparatus 1 of the embodiment, after such range conversion is performed, quantization is carried out, so that quantization accuracy can be improved. The range conversion unit 12 supplies range converted spectral signals to the quantization accuracy determining unit 13.

Then, in step S5, the quantization accuracy determining unit 13 determines quantization accuracy of each range conversion spectrum based on the normalization factor index idsf supplied from the frequency normalization unit 11, and supplies the range converted spectral signal and the quantization accuracy index idwl to be explained later to the quantization unit 14. Further, the quantization accuracy determining unit 13 supplies weight information used in determining the quantization accuracy to the encoding/code string generating unit 15, but details on the quantization accuracy determining processing using the weight information will be explained later.

Next, in step S6, the quantization unit 14 quantizes each range conversion spectrum at the quantization step of "2^a" if the quantization accuracy index idwl supplied from the quantization accuracy determining unit 13 is "a", generates a quantized spectrum, and supplies the quantized spectral signal to the encoding/code string generating unit 15. An example of a relationship between the quantization accuracy index idwl and the quantization step nsteps is shown in Table 2 below. Note that in this Table 2, the quantization step in case the quantization accuracy index idwl is "a" is considered to be "2^a-1".

TABLE 2

| idwl | ... | 6 | 5 | 4 | 3 | 2 | ... |
|---|---|---|---|---|---|---|---|
| nsteps | ... | 63 (±31) | 31 (±15) | 15 (±7) | 7 (±3) | 3 (±1) | ... |

Figure 6:
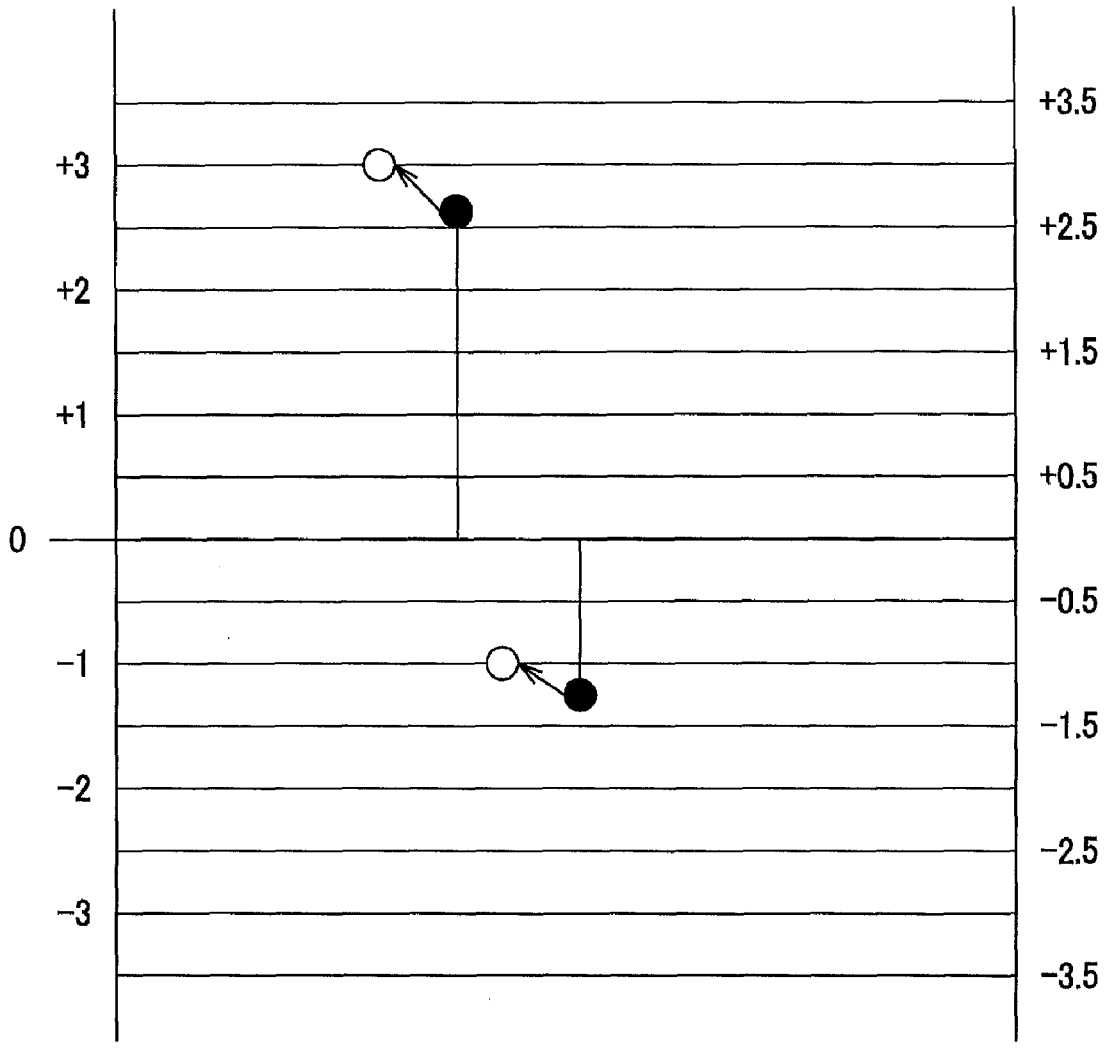
FIG. 6 is a diagram to explain an example of quantization processing in a quantization unit of the signal encoding apparatus.

As a result, for example, if the quantization accuracy index idwl is 3, the range conversion spectral value is set as nspec and when the quantized spectral value is set as $q(-3 \leqq q \leqq 3)$, then according to the following equation (1), quantization is made as shown in FIG. 6. Note that a black dot in FIG. 6 represents a range conversion spectral value, while a white dot represents a quantized spectral value.

$$q=(\text{int})(\text{floor}(n\text{spec}*3.5)+0.5) \quad (1)$$

Thereafter, in step S7, the encoding/code string generating unit 15 encodes, respectively, information on the number of spectra supplied from the time-frequency conversion unit 10, normalization factor index idsf supplied from the frequency normalization unit 11, weight information supplied from the quantization accuracy determining unit 13, and the quantized spectral signal, generates a code string in step S8, and outputs this code string in step S9.

Finally, in step S10, whether or not there is the last frame of the audio signal is determined, and if "Yes", encoding processing is complete. If "No", the process returns to step S1 to input an audio signal of the next frame.

At this point, details on the processing in the quantization accuracy determining unit 13 will be explained. Note that although the quantization accuracy determining unit 13 determines the quantization accuracy per range conversion spectrum by using weight information as mentioned above, in the following, a case where quantization accuracy is determined first without using the weight information will be described.

The quantization accuracy determining unit 13 uniquely determines the quantization accuracy index idwl of each range conversion spectrum from the normalization factor index idsf per normalized spectrum, supplied from the frequency normalization unit 11 and a preset variable A as shown in Table 3 below.

TABLE 3

| idsf | 31 | 30 | 29 | 28 | 27 | ... | 17 | 16 | 15 | 14 | ... | 0 |
|---|---|---|---|---|---|---|---|---|---|---|---|---|
| idwl | A | A-1 | A-2 | A-3 | A-4 | ... | A-14 | A-15 | A-16 | A-17 | ... | A-31 |

Clearly from this Table, as the normalization factor index idsf becomes smaller by 1, the quantization accuracy index idwl also becomes smaller by 1, a gain decreasing to a maximum of 6 dB. This is a result of focusing on the following. Assume that the absolute SNR (Signal to Noise Ratio) is set at SNRabs when the normalization factor index idsf is X and the quantization accuracy is B. In this case, when the normalization factor index idsf is X-1, a quantization accuracy of approximately B-1 is required in order to obtain the identical SNRabs. Further, if the normalization factor index idsf is X-2, similarly, a quantization accuracy of approximately B-2 is required. Specifically, in a case where the normalization factors are 4, 2, and 1 and the quantization accuracy indexes idwl are 3, 4, 5, and 6, the absolute maximum quantization error is shown in Table 4 below.

TABLE 4

| | Normalization coefficient | | |
|---|---|---|---|
| | 4 | 2 | 1 |
| Absolute maximum quantization error (idwl = 3, Emax = 1/7) | 4/7 = 0.571 | 2/7 = 0.285 | 1/7 = 0.142 (B-2) |
| Absolute maximum quantization error (idwl = 4, Emax = 1/15) | 4/15 = 0.266 | 2/15 = 0.133 (B-1) | 1/15 = 0.066 (B-2) |
| Absolute maximum quantization error (idwl = 5, Emax = 1/31) | 4/31 = 0.129 (B) | 2/31 = 0.064 (B-1) | 1/31 = 0.032 |
| Absolute maximum quantization error (idwl = 6, Emax = 1/63) | 4/63 = 0.063 (B) | 2/63 = 0.032 | 1/63 = 0.016 |

As apparent from this Table 4, the absolute maximum quantization error (=0.129) when the normalization factor is 4 and the quatization accuracy index idwl is 5 is approximately the identical value of the absolute maximum quantization error (=0.133) when the normalization factor is 2 and the quantization accuracy index idwl is 4. Note that if the quantization step nsteps is set at "2^a" when the quantization accuracy index idwl is "a", there are B, B-1, and B-2 mutually in complete agreement. Nonetheless, since the quantization step nsteps is herein set at "2^a-1" like the above-mentioned Table 1, a slight error is generated.

The above-mentioned variable A shows the maximum quantized number of bits (the maximum quantization information) allocated to the maximum normalization factor index idsf and this value is included in the code string as additional information. Note that, as explained later, first the maximum quantized number of bits that can be set in terms of standard is set as the variable A, and as a result of encoding, if the total number of bits used exceeds the total usable number of bits, the number of bits will be brought down sequentially.

When the value of the variable A is 17 bits, an example in the Table showing a relationship between the normalization factor index idsf and the quantization accuracy index idwl for each range conversion spectrum is presented in the following Table 5. Figures encircled in the Table 5 represent the quantization accuracy index idwl determined per range conversion spectrum.

If, at this point, the corresponding normalization factor index idsf is less than the maximum normalization factor index idsf by over 17, the quantized bit becomes negative. In that case, the lower limit will be set as 0 bit. Note that since 5 bits are given to the normalization factor index idsf, even if the quantized number of bits becomes 0 bit in the Table 5, through description with 1 bit only for code bits, spectral information can be recorded at an accuracy of 3 db as the mean SNR, such code bit recording is not essential.

Figure 7:
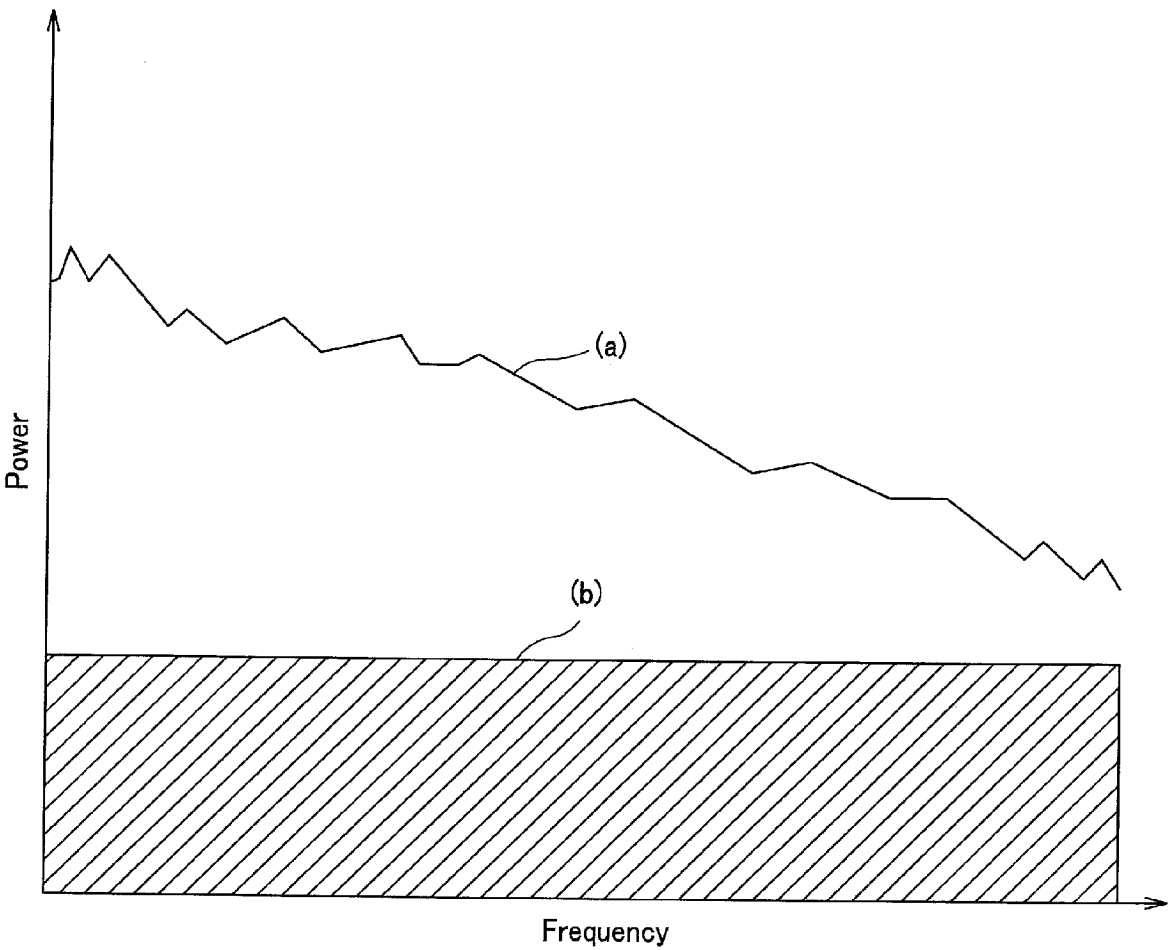
FIG. 7 is a diagram showing a normal line and a noise floor of a spectrum when a normalization factor index is not weighted.

As described above, FIG. 7 shows the spectral normal line (a) and the nose floor (b) when the quantization accuracy index of each range conversion spectrum is uniquely determined from the normalization factor index idsf. As shown in FIG. 7, the noise floor in this case is approximately flat. Namely, in the low frequency range important for human hearing and the high frequency range not important for hearing, quantization is carried out with the same degree of quantization accuracy, and hence, the noise level does not become minimum.

Now, the quantization accuracy determining unit 13 in the present embodiment actually performs weighting of the normalization factor index idsf per range conversion spectrum, and by using the weighted normalization factor index idsf1, in the same way as described above, the quantization accuracy index idwl is determined.

TABLE 5

Spectral index →; Index of Normalization factor ↓

| | 0 | 1 | 2 | 3 | 4 | 5 | 6 | 7 | ... | N/2-5 | N/2-4 | N/2-3 | N/2-2 | N/2-1 |
|---|---|---|---|---|---|---|---|---|---|---|---|---|---|---|
| 31 | 17 | 17 | 17 | 17 | 17 | 17 | 17 | 17 | ... | 17 | 17 | 17 | 17 | 17 |
| 30 | 16 | 16 | 16 | 16 | 16 | 16 | 16 | 16 | ... | 16 | 16 | 16 | 16 | 16 |
| 29 | 15 | 15 | 15 | 15 | 15 | 15 | 15 | 15 | ... | 15 | 15 | 15 | 15 | 15 |
| 28 | 14 | 14 | 14 | 14 | 14 | 14 | 14 | 14 | ... | 14 | 14 | 14 | 14 | 14 |
| 27 | 13 | 13 | 13 | 13 | 13 | 13 | 13 | 13 | ... | 13 | 13 | 13 | 13 | 13 |
| 26 | 12 | 12 | 12 | 12 | 12 | 12 | 12 | 12 | ... | 12 | 12 | 12 | 12 | 21 |
| ... | ... | ... | ... | ... | ... | ... | ... | ... | ... | ... | ... | ... | ... | ... |
| 18 | 4 | 4 | 4 | 4 | 4 | 4 | 4 | 4 | ... | 4 | 4 | 4 | 4 | 4 |
| 17 | 3 | 3 | 3 | 3 | 3 | 3 | 3 | 3 | ... | 3 | 3 | 3 | 3 | 3 |
| 16 | 2 | 2 | 2 | 2 | 2 | 2 | 2 | 2 | ... | 2 | 2 | 2 | 2 | 2 |
| 15 | 1 | 1 | 1 | 1 | 1 | 1 | 1 | 1 | ... | 1 | 1 | 1 | 1 | 1 |
| 14 | 0 | 0 | 0 | 0 | 0 | 0 | 0 | 0 | ... | 0 | 0 | 0 | 0 | 0 |
| 13 | 0 | 0 | 0 | 0 | 0 | 0 | 0 | 0 | ... | 0 | 0 | 0 | 0 | 0 |
| ... | ... | ... | ... | ... | ... | ... | ... | ... | ... | ... | ... | ... | ... | ... |
| 0 | 0 | 0 | 0 | 0 | 0 | 0 | 0 | 0 | ... | 0 | 0 | 0 | 0 | 0 |

As shown in Table 5, when the normalization factor index idsf is a maximum 31, quantization is carried out with 17 bits, which is the maximum quantized number of bits. For example, if the normalization factor index idsf is 29, which is less than the maximum normalization factor index idsf by 2, quantization is carried out with 15 bits.

Specifically, first, as shown in Table 6 below, the weighting factor Wn[i](i=0 to N/2-1) is added to the normalization factor index idsf of each range conversion spectrum, generating a new normalization factor index idsf1.

TABLE 6

| | 0 | 1 | 2 | 3 | 4 | 5 | 6 | 7 | . . . | N/2-5 | N/2-4 | N/2-3 | N/2-2 | N/2-1 |
|---|---|---|---|---|---|---|---|---|---|---|---|---|---|---|
| idsf | 31 | 29 | 27 | 26 | 28 | 27 | 26 | 26 | . . . | 17 | 15 | 16 | 13 | 14 |
| Wn | 4 | 4 | 3 | 3 | 2 | 2 | 1 | 1 | . . . | 0 | 0 | 0 | 0 | 0 |
| idsf1 | 35 | 33 | 30 | 29 | 30 | 29 | 27 | 27 | . . . | 17 | 15 | 16 | 13 | 14 |

In this example of Table 6, values of 4 to 1 are added to the low normalization factor index idsf, while no values are added to the high normalization factor index idsf. As a result, the maximum value of the normalization factor index idsf becomes 35, and hence, if the table of Table 5 is simply expanded to a larger direction by 4 which is the maximum added value of the normalization factor index idsf, for example, something like Table 7 below may be obtained. In this Table 7, figures encircled with dotted lines represent the quantization accuracy index idwl determined per range conversion spectrum in case no weighting is conducted, while figures encircled with solid lines represent the quantization accuracy index idwl1 determined per range conversion spectrum in case weighting is conducted.

In this example of Table 7, although the low quantization accuracy improves, the maximum quantized number of bits (the maximum quantization information) increases to increase the total number of bits used, so that there is a possibility that the total number of bits used exceeds the total usable number of bits. Consequently, in reality, bit adjustments are made to put the total number of bits used within the total usable number of bits, thus, for example, leading to a table shown in Table 8 below. In this example, the total number of bits used is adjusted by reducing the maximum quantized number of bits (the maximum quantization information) from 21 of Table 7 to 9.

TABLE 7

| | 0 | 1 | 2 | 3 | 4 | 5 | 6 | 7 | . . . | N/2-5 | N/2-4 | N/2-3 | N/2-2 | N/2-1 |
|---|---|---|---|---|---|---|---|---|---|---|---|---|---|---|
| 35 | 21 | 21 | 21 | 21 | 21 | 21 | 21 | 21 | . . . | 21 | 21 | 21 | 21 | 21 |
| 34 | 20 | 20 | 20 | 20 | 20 | 20 | 20 | 20 | . . . | 20 | 20 | 20 | 20 | 20 |
| 33 | 19 | 19 | 19 | 19 | 19 | 19 | 19 | 19 | . . . | 19 | 19 | 19 | 19 | 19 |
| 32 | 18 | 18 | 18 | 18 | 18 | 18 | 18 | 18 | . . . | 18 | 18 | 18 | 18 | 18 |
| 31 | 17 | 17 | 17 | 17 | 17 | 17 | 17 | 17 | . . . | 17 | 17 | 17 | 17 | 17 |
| 30 | 16 | 16 | 16 | 16 | 16 | 16 | 16 | 16 | . . . | 16 | 16 | 16 | 16 | 16 |
| 29 | 15 | 15 | 15 | 15 | 15 | 15 | 15 | 15 | . . . | 15 | 15 | 15 | 15 | 15 |
| 28 | 14 | 14 | 14 | 14 | 14 | 14 | 14 | 14 | . . . | 14 | 14 | 14 | 14 | 14 |
| 27 | 13 | 13 | 13 | 13 | 13 | 13 | 13 | 13 | . . . | 13 | 13 | 13 | 13 | 13 |
| 26 | 12 | 12 | 12 | 12 | 12 | 12 | 12 | 12 | . . . | 12 | 12 | 12 | 12 | 21 |
| . . . | . . . | . . . | . . . | . . . | . . . | . . . | . . . | . . . | . . . | . . . | . . . | . . . | . . . | . . . |
| 18 | 4 | 4 | 4 | 4 | 4 | 4 | 4 | 4 | . . . | 4 | 4 | 4 | 4 | 4 |
| 17 | 3 | 3 | 3 | 3 | 3 | 3 | 3 | 3 | . . . | 3 | 3 | 3 | 3 | 3 |
| 16 | 2 | 2 | 2 | 2 | 2 | 2 | 2 | 2 | . . . | 2 | 2 | 2 | 2 | 2 |
| 15 | 1 | 1 | 1 | 1 | 1 | 1 | 1 | 1 | . . . | 1 | 1 | 1 | 1 | 1 |
| 14 | 0 | 0 | 0 | 0 | 0 | 0 | 0 | 0 | . . . | 0 | 0 | 0 | 0 | 0 |
| 13 | 0 | 0 | 0 | 0 | 0 | 0 | 0 | 0 | . . . | 0 | 0 | 0 | 0 | 0 |
| . . . | . . . | . . . | . . . | . . . | . . . | . . . | . . . | . . . | . . . | . . . | . . . | . . . | . . . | . . . |
| 0 | 0 | 0 | 0 | 0 | 0 | 0 | 0 | 0 | . . . | 0 | 0 | 0 | 0 | 0 |

TABLE 8

| | 0 | 1 | 2 | 3 | 4 | 5 | 6 | 7 | . . . | N/2-5 | N/2-4 | N/2-3 | N/2-2 | N/2-1 |
|---|---|---|---|---|---|---|---|---|---|---|---|---|---|---|
| 35 | 19 | 19 | 19 | 19 | 19 | 19 | 19 | 19 | . . . | 19 | 19 | 19 | 19 | 19 |
| 34 | 18 | 18 | 18 | 18 | 18 | 18 | 18 | 81 | . . . | 18 | 18 | 18 | 18 | 18 |
| 33 | 17 | 17 | 17 | 17 | 17 | 17 | 17 | 17 | . . . | 17 | 17 | 17 | 17 | 17 |
| 32 | 16 | 16 | 16 | 16 | 16 | 16 | 16 | 16 | . . . | 16 | 16 | 16 | 16 | 16 |
| 31 | 15 | 15 | 15 | 15 | 15 | 15 | 15 | 15 | . . . | 15 | 15 | 15 | 15 | 15 |
| 30 | 14 | 14 | 14 | 14 | 14 | 14 | 14 | 14 | . . . | 14 | 14 | 14 | 14 | 14 |
| 29 | 13 | 13 | 13 | 13 | 13 | 13 | 13 | 13 | . . . | 13 | 13 | 13 | 13 | 13 |
| 28 | 12 | 12 | 12 | 12 | 12 | 12 | 12 | 12 | . . . | 12 | 12 | 12 | 12 | 12 |
| 27 | 11 | 11 | 11 | 11 | 11 | 11 | 11 | 11 | . . . | 11 | 11 | 11 | 11 | 11 |
| 26 | 10 | 10 | 10 | 10 | 10 | 10 | 10 | 10 | . . . | 10 | 10 | 10 | 10 | 10 |
| . . . | . . . | . . . | . . . | . . . | . . . | . . . | . . . | . . . | . . . | . . . | . . . | . . . | . . . | . . . |
| 18 | 2 | 2 | 2 | 2 | 2 | 2 | 2 | 2 | . . . | 2 | 2 | 2 | 2 | 2 |
| 17 | 1 | 1 | 1 | 1 | 1 | 1 | 1 | 1 | . . . | 1 | 1 | 1 | 1 | 1 |
| 16 | 0 | 0 | 0 | 0 | 0 | 0 | 0 | 0 | . . . | 0 | 0 | 0 | 0 | 0 |
| 15 | 0 | 0 | 0 | 0 | 0 | 0 | 0 | 0 | . . . | 0 | 0 | 0 | 0 | 0 |
| 14 | 0 | 0 | 0 | 0 | 0 | 0 | 0 | 0 | . . . | 0 | 0 | 0 | 0 | 0 |
| 13 | 0 | 0 | 0 | 0 | 0 | 0 | 0 | 0 | . . . | 0 | 0 | 0 | 0 | 0 |
| . . . | . . . | . . . | . . . | . . . | . . . | . . . | . . . | . . . | . . . | . . . | . . . | . . . | . . . | . . . |
| 0 | 0 | 0 | 0 | 0 | 0 | 0 | 0 | 0 | . . . | 0 | 0 | 0 | 0 | 0 |

A comparison of the quantization accuracy index determined in Table 5 and the quantization accuracy index idw11 determined in Table 8 results in what is presented in Table 9 below.

TABLE 9

| | 0 | 1 | 2 | 3 | 4 | 5 | 6 | 7 | . . . | N/2-5 | N/2-4 | N/2-3 | N/2-2 | N/2-1 |
|---|---|---|---|---|---|---|---|---|---|---|---|---|---|---|
| idw10 | 17 | 15 | 13 | 12 | 14 | 13 | 12 | 12 | . . . | 3 | 1 | 2 | 0 | 0 |
| idw11 | 19 | 17 | 14 | 13 | 14 | 13 | 11 | 11 | . . . | 1 | 0 | 0 | 0 | 0 |
| diff. | +2 | +2 | +1 | +1 | 0 | 0 | −1 | −1 | . . . | −2 | −1 | −2 | 0 | 0 |

As shown in this Table 9, while the quantization accuracy of the range conversion spectra whose index is 0 to 3 improves, the quantization accuracy of the range conversion spectra whose index is over 6 decreases. In this manner, by adding the weighting factor Wn[i] to the normalization factor index idsf, bits are concentrated on the low frequency range to improve the quality of sound in the band important for human auditory sense.

In the present embodiment, by having in advance a plurality of the weighting factor tables Wn[ ] which are tables of the weighting factors Wn[i] or having a plurality of modeling equations and parameters to generate sequentially the weighting factor table Wn[ ], the characteristics of a sound source (frequency energy, transition properties, gain, masking properties and the like) are determined based on a certain criterion and the weighting factor table Wn[ ] considered to be optimum is put to use. Flowcharts of this determination processing are shown FIG. 8 and FIG. 9.

Figure 8:
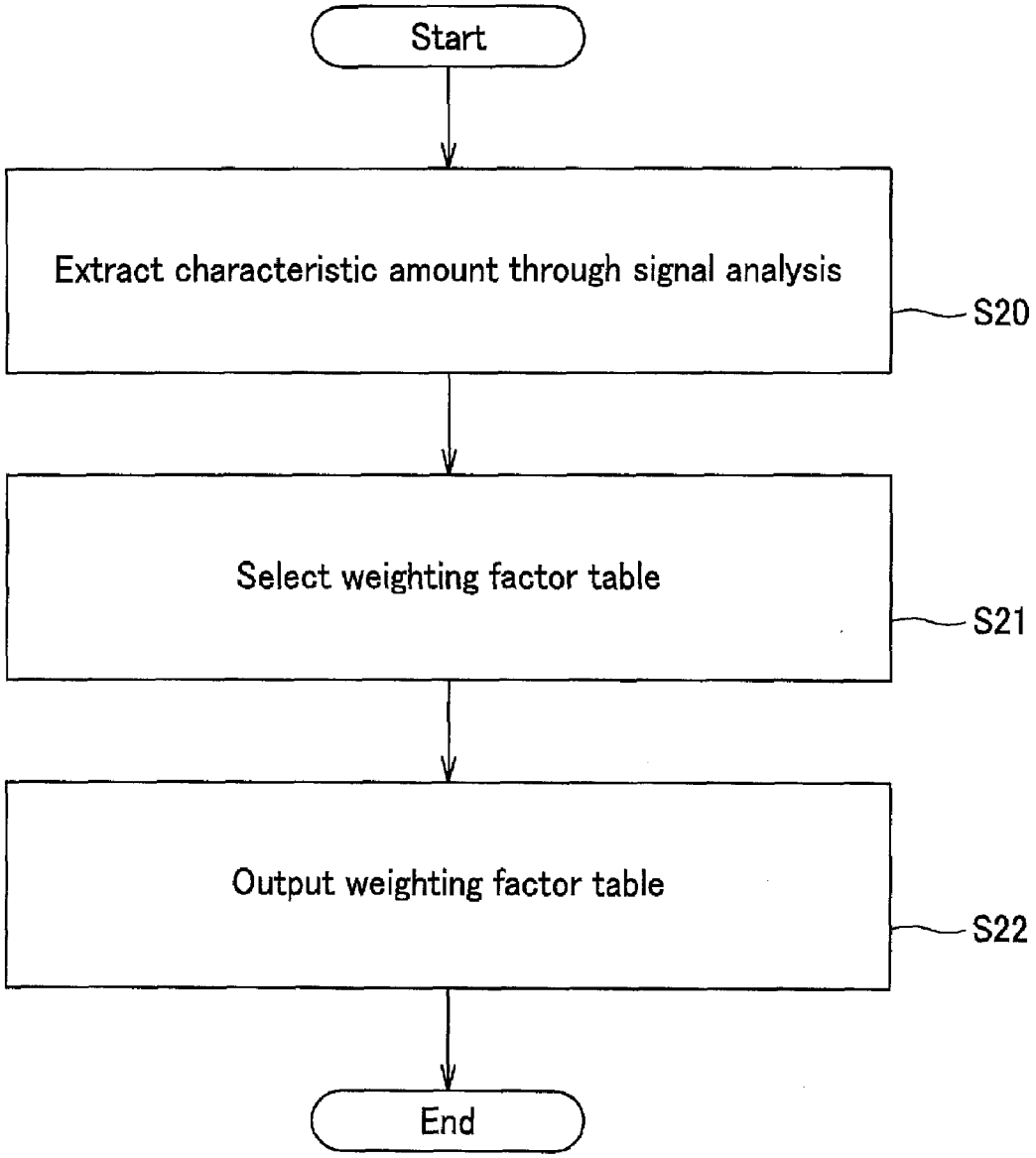
FIG. 8 is a flowchart to explain an example of a method of determining a weighting factor table Wn[ ]
Figure 9:
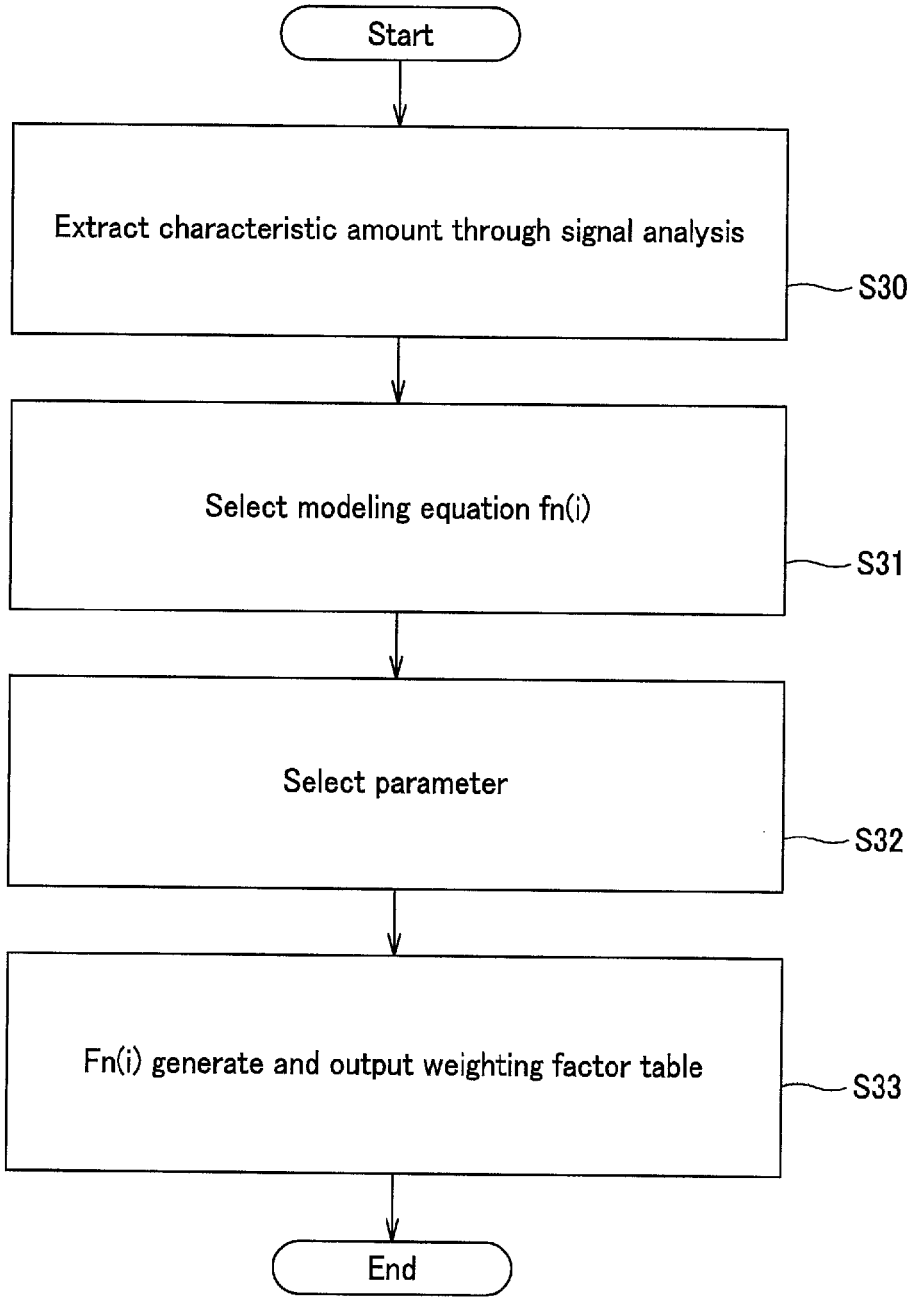
FIG. 9 is a flowchart to explain other example of the method of determining the weighting factor table Wn[ ]

In case of having in advance a plurality of the weighting factor tables Wn[ ], first, in step S20 of FIG. 8, a spectral signal or a time domain audio signal is analyzed and the quantity of characteristics (frequency energy, transition properties, gain, masking properties and the like) is extracted. Next, in step S21, the weighting factor table Wn[ ] is selected based on this quantity of characteristics, and in step S22, an index of the selected weighting factor table Wn[ ] and the weighting factor Wn[i](i=0 to N/2-1) are outputted.

On the other hand, in case of having the plurality of modeling equations and parameters to generate sequentially the weighting factor table Wn[ ], first in step S30, the spectral signal or the time-domain audio signal is analyzed and the quantity of characteristics (frequency energy, transition properties, gain, masking properties and the like) is extracted. Next, in step S31, the modeling equation fn(i) is selected based on this quantity of characteristics. In step S32, parameters a, b, c, . . . of this modeling equation fn(i) are selected. The modeling equation fn(i) at this point means a polynomial equation consisting of a sequence of the range conversion spectra and parameters a, b, c, . . . and expressed, for example, as in formula (2) below.

$$fn(i)=fa(a,i)+fb(b,i)+fc(c,i) \quad (2)$$

Subsequently, in step S33, the modeling equation fn(i) is calculated to generate the weighting factor table Wn[ ] and the index of the modeling equation fn(i), the parameters a, b, c, . . . , and the weighting factor Wn[i](i=0 to N/2-1) are output.

Note that a "certain criterion" in selecting the weighting factor table Wn[ ] is not absolute and can be set freely at each signal encoding apparatus. In the signal encoding apparatus, the index of the selected weighting factor table Wn[ ] or the index of the modeling equation fn(i) and the parameters a, b, c, . . . are included in the code string. In the signal decoding apparatus, the quantization accuracy is re-calculated according to the index of the weighting factor table Wn[ ] or the index of the modeling equation fn(i) and the parameters a, b, c, . . . , and hence, compatibility with the code string generated by the signal encoding apparatus of a different criterion is maintained.

Figure 10:
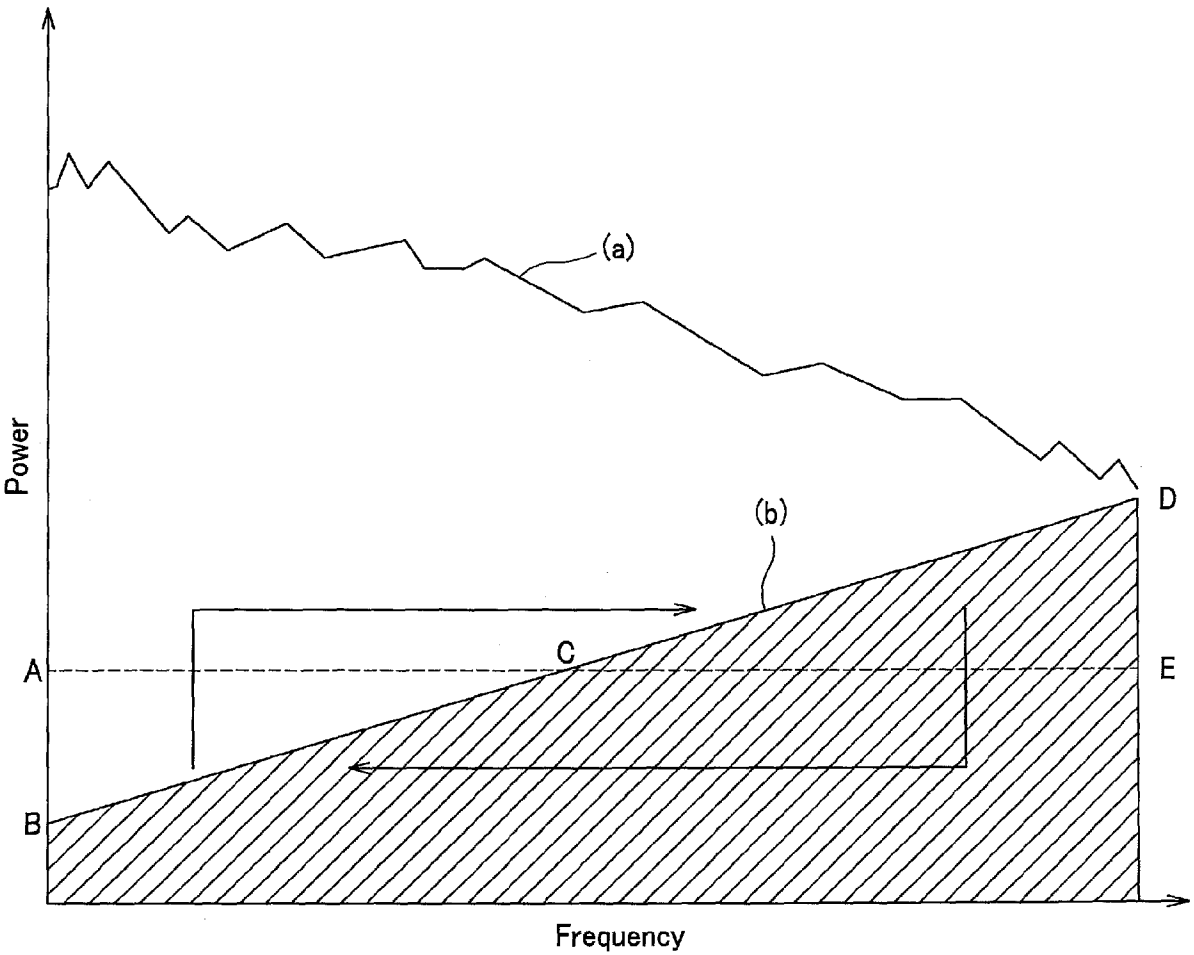
FIG. 10 is a diagram showing the normal line and the noise floor of a spectrum when a normalization factor index is weighted.

As described above, FIG. 10 shows an example of the spectral normal line (a) and the noise floor (b) when the quantization accuracy index of each range conversion spectrum is uniquely determined from a new normalization factor index idsf1 which is the weighted normalization factor index idsf. A noise floor with no addition of the weighting factor Wn[i] is a straight line ACE, while a noise floor with addition of the weighting factor Wn[i] is a straight line BCD. In other words, the weighting factor Wn[i] is what deforms the noise floor from the straight line ACE to the straight line BCD. In the example of FIG. 10, as a result of distributing the bits of a triangle CDE, SNR of the triangle ABC improves to cause the noise floor to be a straight line moving up to the right. Note that, in this example, a triangle was used to simplify the explanation, depending on how to hold the weighting factor Wn[ ] or the modeling equation or the parameters, the noise floor can be deformed to any shape.

Figure 11:
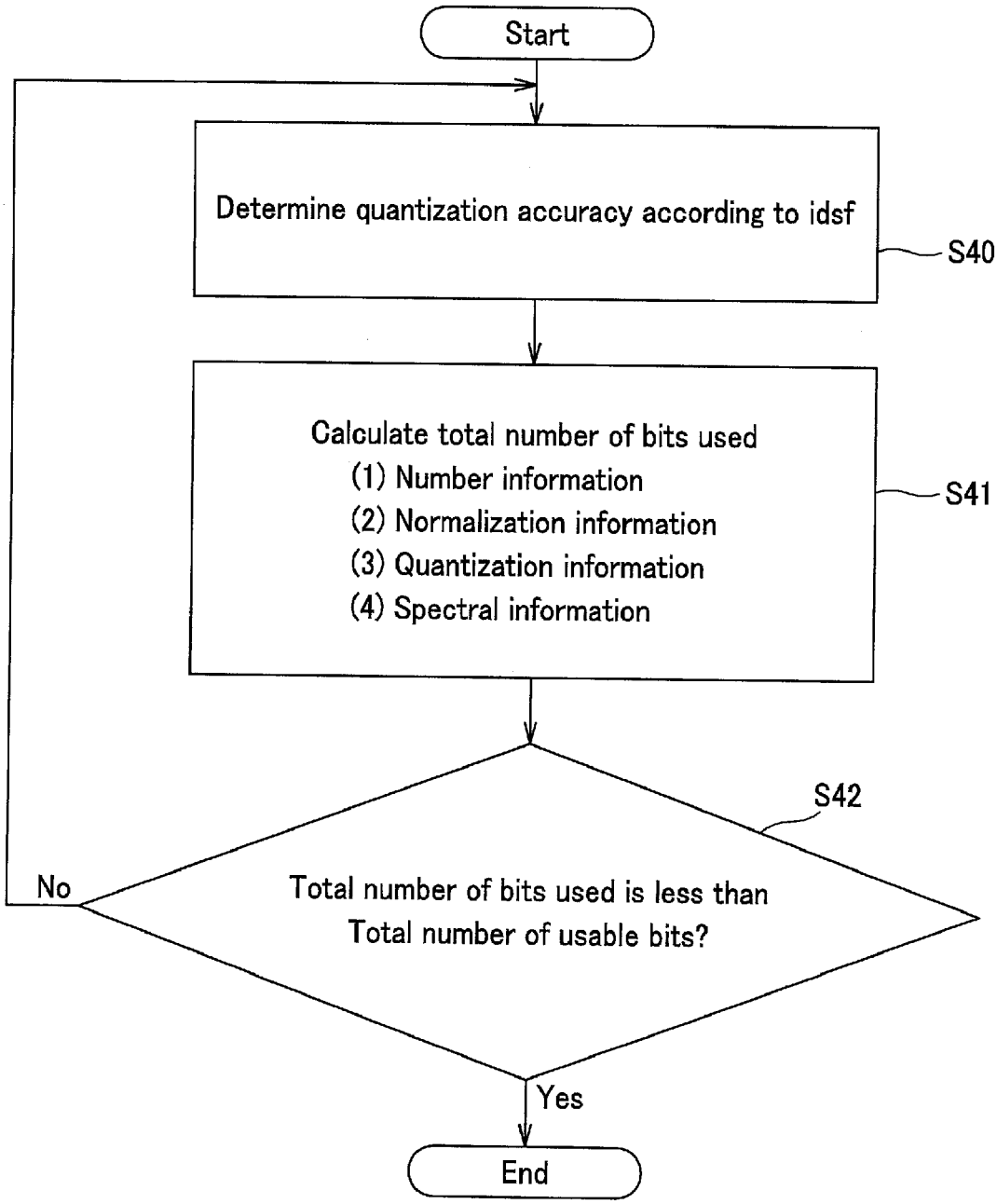
FIG. 11 is a flowchart to explain processing of determining conventional quantization accuracy.
Figure 12:
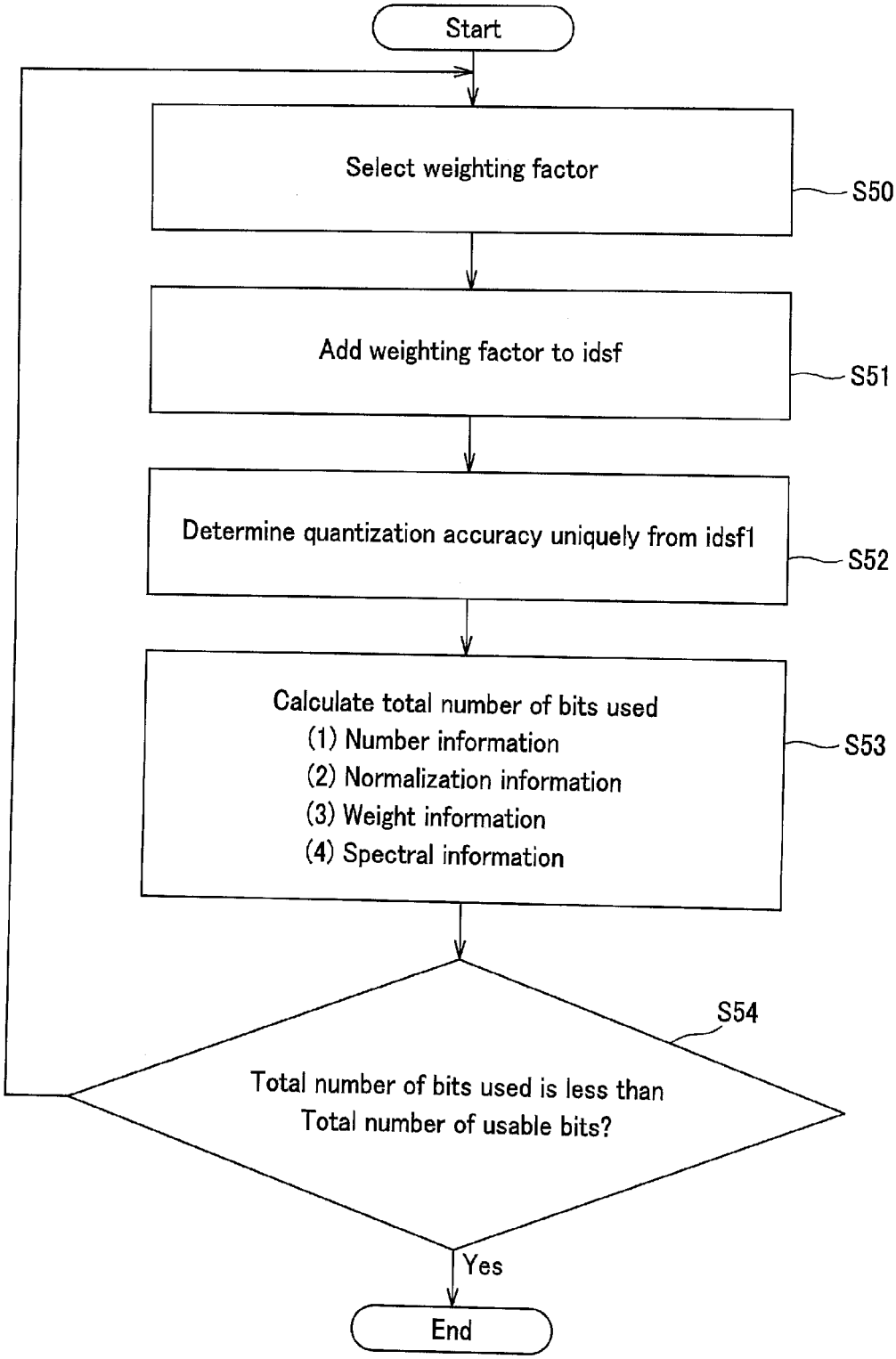
FIG. 12 is a flowchart to explain processing of determining quantization accuracy in the embodiment.

At this point, conventional processing to determine the quantization accuracy and processing to determine the quantization accuracy in the present embodiment are shown in FIG. 11 and FIG. 12.

Conventionally, first, in step S40, the quantization accuracy is determined according to the normalization factor index idsf, and in step S41, the total number of bits used necessary for encoding information on the number of spectra, normalization information, quantization information, and spectral information is calculated. Next, in step S42, determination is made as to whether or not the total number of bits used is less than the total usable number of bits. If the total number of bits used is less than the total usable number of bits (Yes), processing terminates, while if not (No), processing returns to step S40 and the quantization accuracy is again determined.

On the other hand, in the present embodiment, first in step S50, the weighting factor table Wn[ ] is determined as mentioned above, and in step S51, the weighting factor Wn[i] is added to the normalization factor index idsf to generate a new normalization factor index idsf1. Subsequently, in step S52, the quantization accuracy idwl1 is uniquely determined according to the normalization factor index idsf1, and in step S53, the total number of bits used necessary for encoding information on the number of spectra, normalization information, weight information, and spectral information is calculated. Next, in step S54, determination is made as to whether or not the total number of bits used is less than the total usable number of bits. If the total number of bits used is less than the total usable number of bits (Yes), processing terminates, while if not (No), processing returns to step S50 and the weighting factor table Wn[ ] is again determined.

Figure 13:
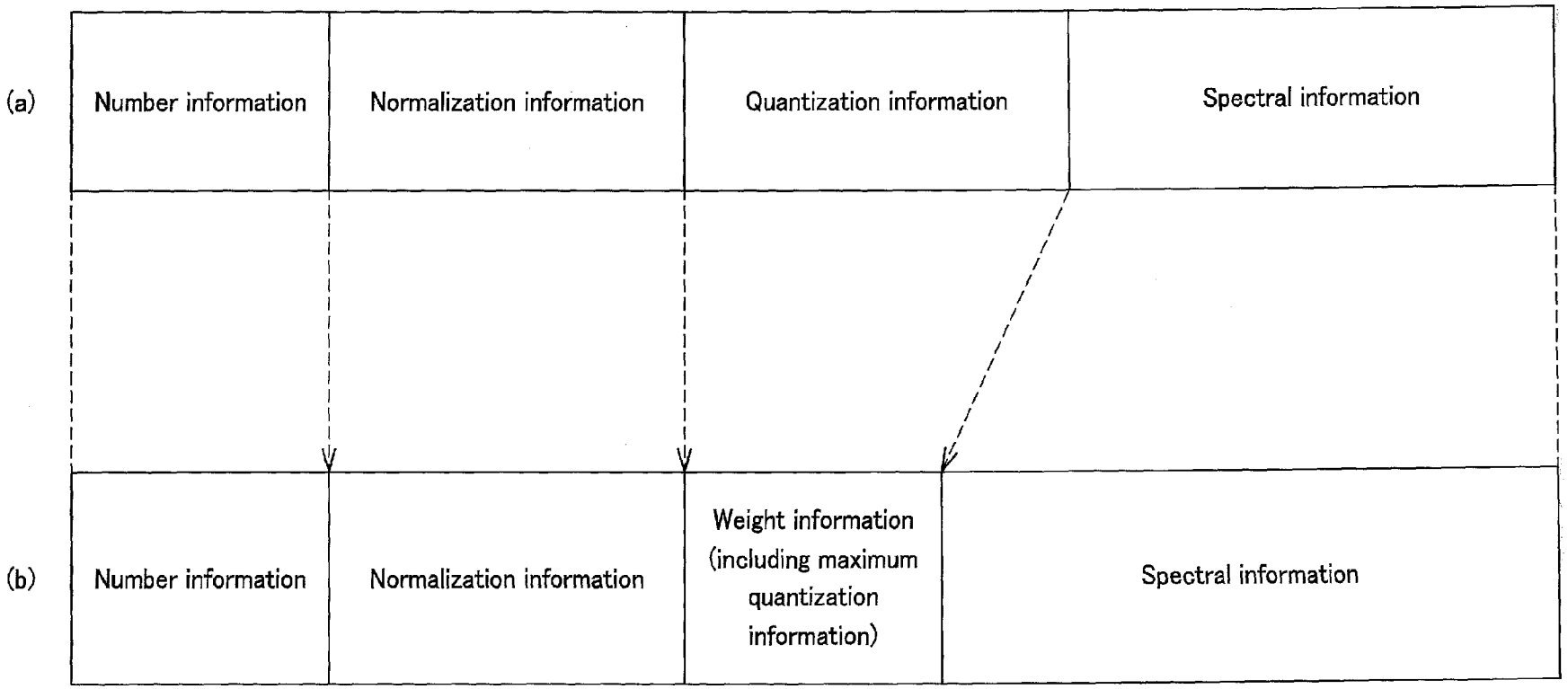
FIG. 13 is a diagram showing a code string in case of determining the quantization accuracy according to FIG. 11 and a code string in case of determining the quantization accuracy according to FIG. 12.

A code string when the quantization accuracy is determined according to FIG. 11 and a code string when the quantization accuracy is determined according to FIG. 12 are respectively shown in FIGS. 13(*a*) and 13(*b*). As shown in FIG. 13, by using the weighting factor table Wn[ ], weight information (including the maximum quantization information) can be encoded by the number of bits less than the number of bits conventionally necessary for encoding the quantization information, and hence, excess bits can be used for encoding spectral information.

Note that the above-mentioned weighting factor table Wn[ ] can no longer be changed at the stage of determining the standard of the signal decoding apparatus. Consequently, the following setup is built in beforehand.

Figure 14:
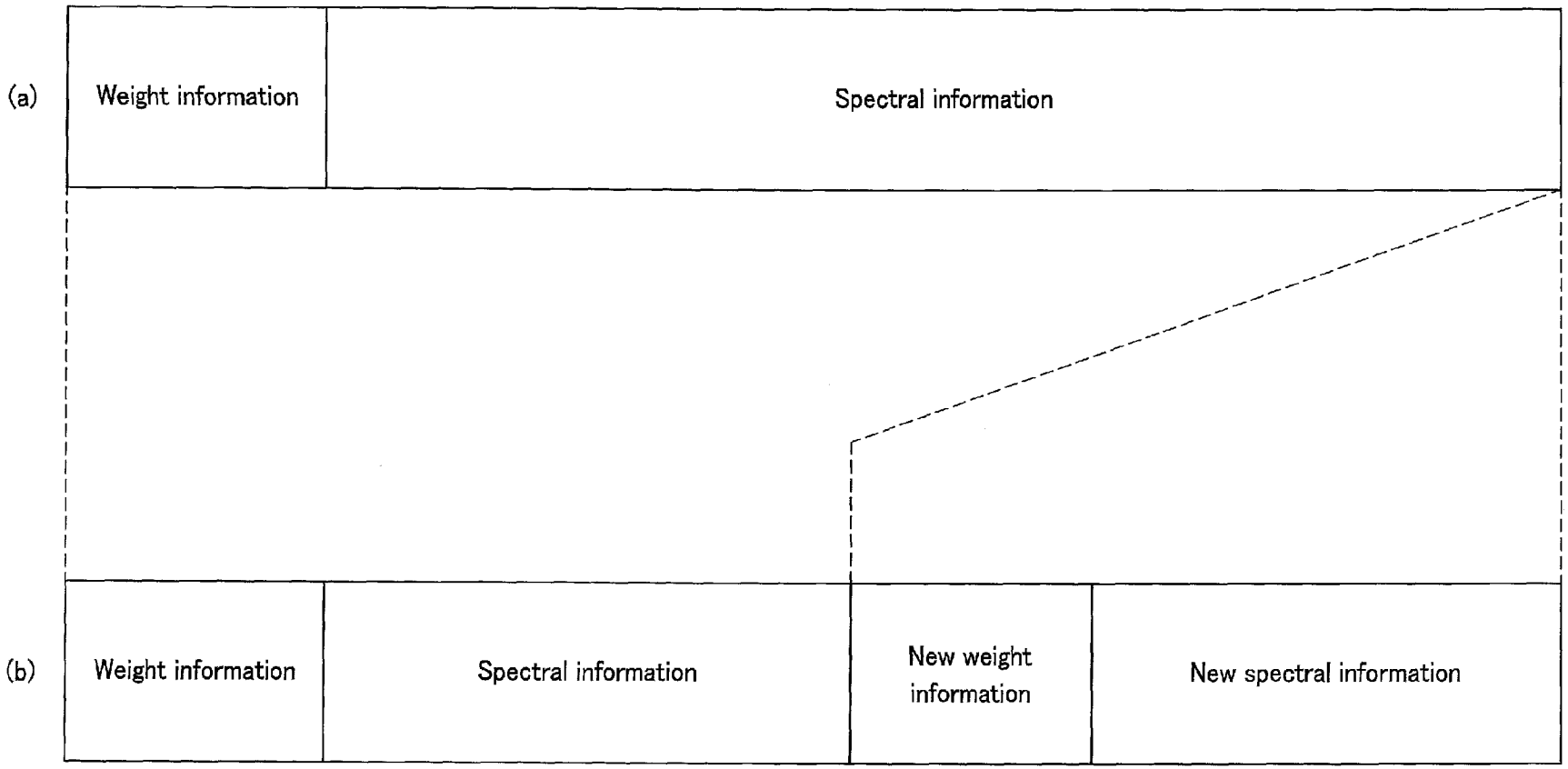
FIG. 14 is a diagram to explain a method of securing backward compatibility in case the specification of the weighting factor is changed.

First, the maximum quantized number of bits in the above example is the quantized number of bits given to the maximum normalization factor index idsf, and the closest value that the total number of bits used does not exceed the total usable number of bits. This is set such that the total number of bits used has some margin with respect to the total usable number of bits. Take FIG. 8 for instance. Although the maximum quantized number of bits is 19 bits, this is set to a small value such as 10 bits. In this case, code strings where excess bits occur in great numbers is generated. However, such data is discarded in the signal decoding apparatus at that time. In a next generation signal encoding apparatus and signal decoding apparatus, the excess bits are allocated according to a newly established standard and encoded and decoded, so that there is an advantage of securing backward compatibility. Specifically, in such signal decoding apparatus as shown in FIG. 14(*a*), the number of bits to be used for decodable code strings is reduced, so that excess bits can be distributed, as shown in FIG. 14(*b*), to new weight information and new spectral information encoded using the new weight information.

Figure 15:
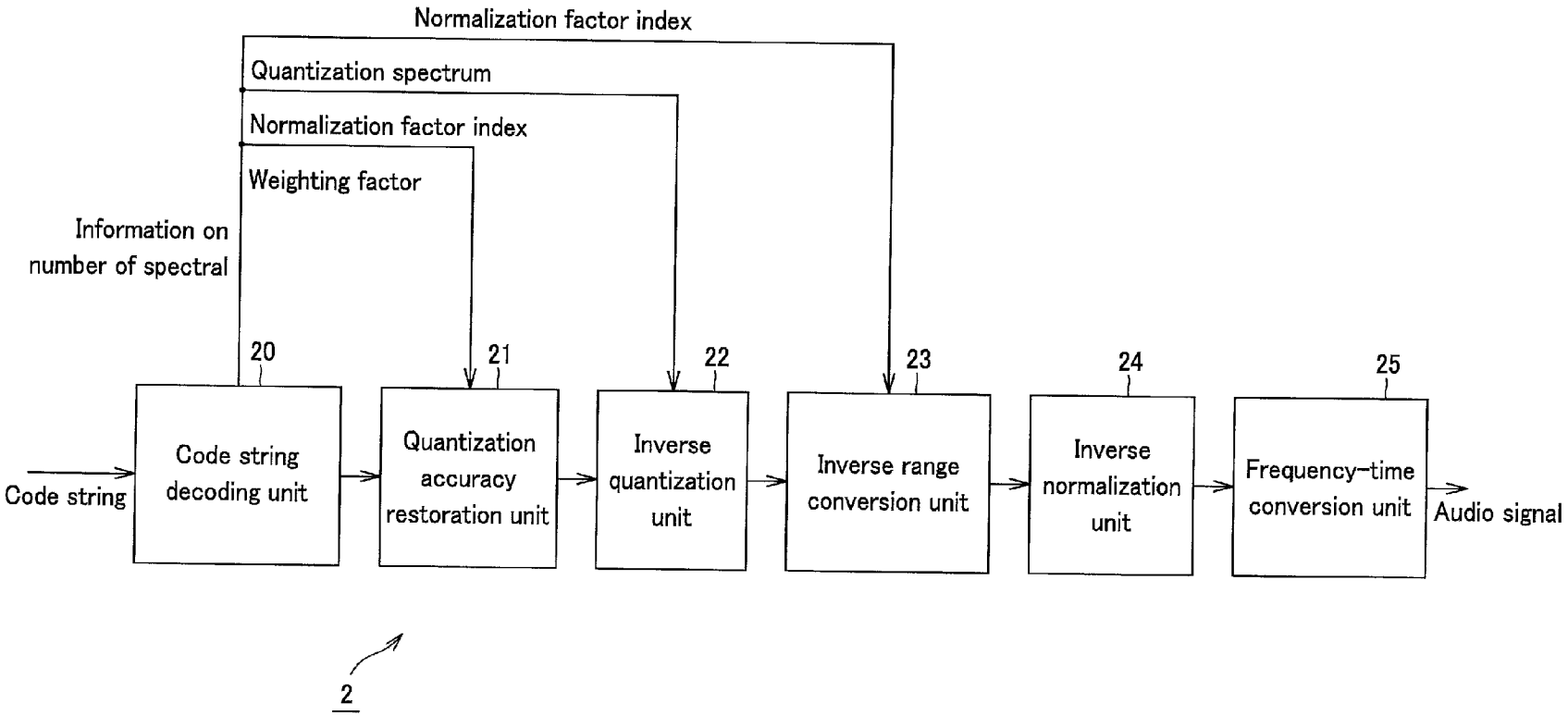
FIG. 15 is a diagram showing a schematic construction of a signal decoding apparatus according to the embodiment.

Next, a schematic structure of a signal decoding apparatus in the present embodiment is shown in FIG. 15. Further, a procedure of decoding processing in the signal decoding apparatus 2 shown in FIG. 15 is shown in a flowchart of FIG. 16. With reference to FIG. 15, the flowchart of FIG. 16 will be described as follows.

Figure 16:
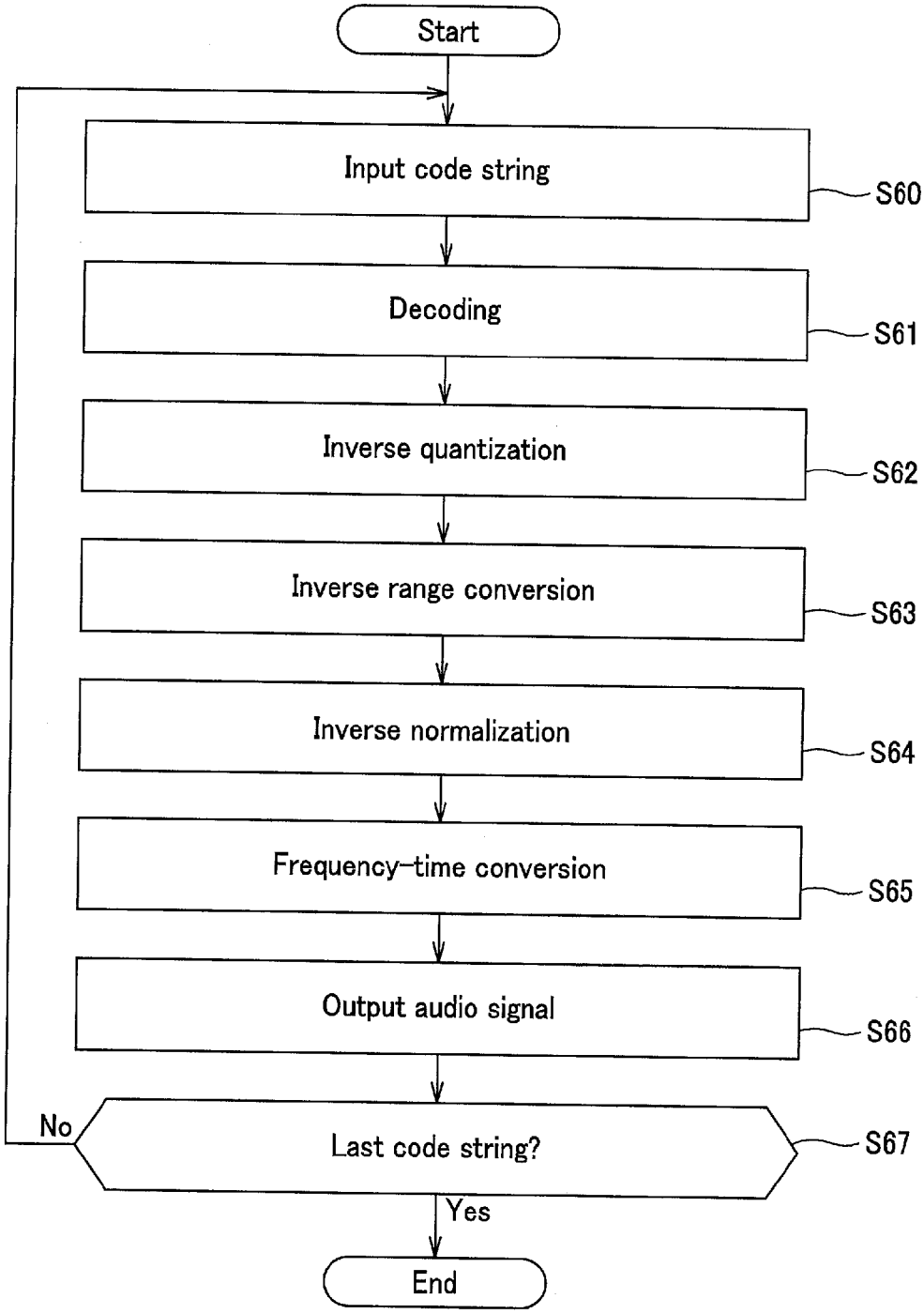
FIG. 16 is a flowchart to explain a procedure of decoding processing in the signal decoding apparatus.

In step S60 of FIG. 16, a code string decoding unit 20 inputs a code string encoded per preset unit time (frame) and decodes this code string in step S61. At this time, the code string decoding unit 20 supplies information on the number of decoded spectra, normalization information, and weight information (including the maximum quantization information) to a quantization accuracy restoring unit 21, and the quantization accuracy restoring unit 21 restores the quantization accuracy index idwl1 based on these pieces of information. Further, the code string decoding unit 20 supplies information on the number of spectra and a quantized spectral signal to an inverse quantization unit 22 and sends information on the number of decoded spectra and the normalization information to an inverse normalization unit 24.

Figure 17:
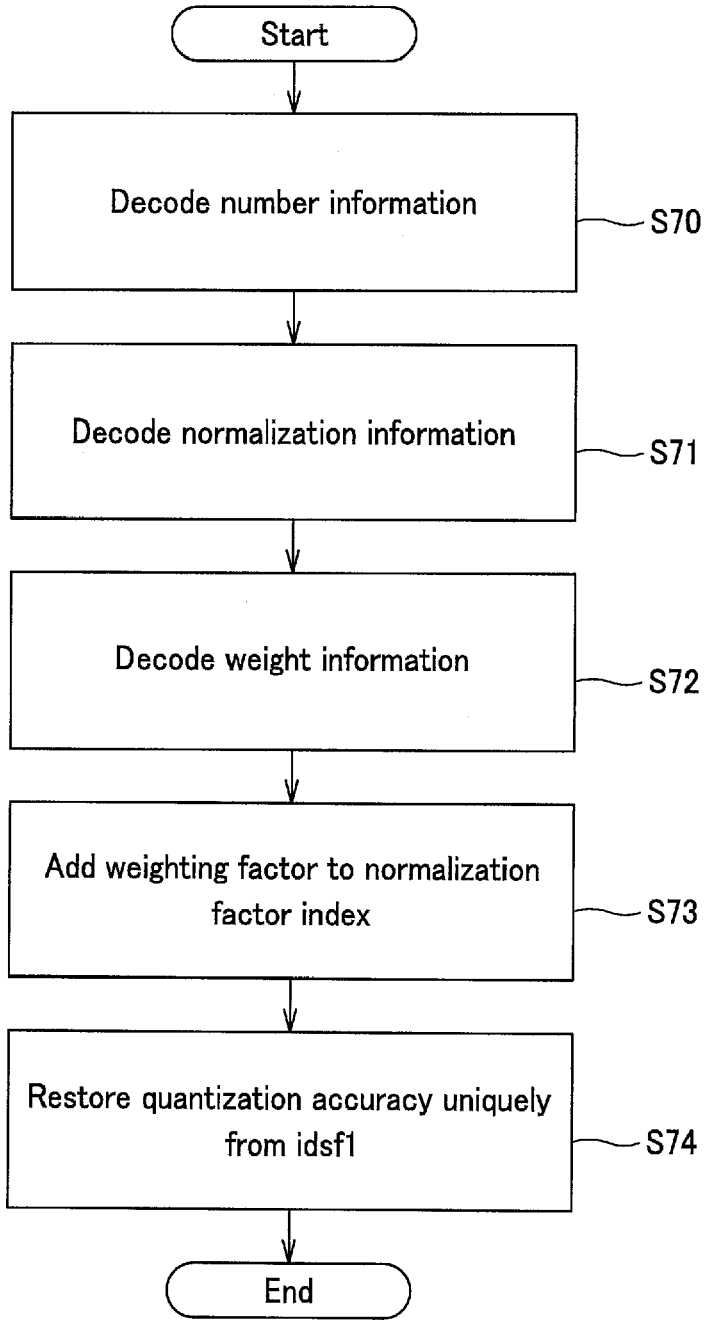
FIG. 17 is a flowchart to explain processing in the code string decoding unit and the quantization accuracy restoring unit of the signal decoding apparatus.

Processing of the code string decoding unit 20 and the quantization accuracy restoring unit 21 in step S61 will be described in further detail using the flowchart in FIG. 17. First, information on the number of spectra is decoded in step S70, normalization information is decoded in step S71, and the weight information is decoded in step S72. Next, in step S73, the weighting factor Wn is added to the normalization factor index idsf which was obtained by decoding the normalization information to generate the normalization factor index idsf1, then, in step S74, the quantization accuracy index idwl1 is uniquely restored from this normalization factor index idsf1.

Back to FIG. 16, in step S62, the inverse quantization unit 22 inversely quantizes a quantized spectral signal based on the quantization accuracy index idwl1 supplied from the quantization accuracy restoring unit 21 and generates the range conversion spectral signal. The inverse quantization unit 22 supplies this range conversion spectral signal to the inverse range conversion unit 23.

Thereafter, in step S63, the inverse range conversion unit 23 subjects the range conversion spectral values, which have been range converted to the range from 0.0 to ±1.0, to inverse range conversion over a range from ±0.5 to ±1.0 and generates a normalized spectral signal. The inverse range conversion unit 23 supplies this normalized spectral signal to the inverse normalization unit 24.

Now, in step S64, the inverse normalization unit 24 inversely normalizes the normalized spectral signal using the normalization factor index idsf, which was obtained by decoding the normalization information, and supplies a spectral signal obtained to a frequency-time conversion unit 25.

Then, in step S65, the frequency-time conversion unit 25 converts the spectral signal supplied from the inverse normalization unit 24 to a time domain audio signal (PCM data and the like) through inverse MDCT, and in step S66, outputs this audio signal.

Finally, in step S67, determination is made as to whether this is a last code string of the audio signal. If it is the last code string (Yes), decoding processing terminates, and if not (No), processing returns to step S60 and a next frame code string is inputted.

As described above, according to the signal encoding apparatus 1 and the signal decoding apparatus 2 in the present embodiment, in the signal encoding apparatus 1, the weighting factor Wn[i] using the auditory properties is prepared when allocating bits by relying on each spectral value, weight information on the weighting factor Wn[i] is encoded together with the normalization factor index idsf and the quantized spectral signal, and included in the code string. In the signal decoding apparatus 2, by using the weighting factor Wn[i] obtained by decoding this code string, the quantization accuracy per quantized spectrum is restored, and the noise level at the time of reproduction can be minimized by inversely quantizing the quantized spectral signal according to the quantization accuracy.

Further, in the present embodiment, there is no concept of critical band, all spectra are normalized by their respective normalization factors and the normalization factor are all encoded and included in the code string. In this manner, a record of the normalization factor is required not per critical band but per spectrum, thus bringing about a disadvantage in terms of information efficiency but a significant advantage in terms of absolute accuracy. However, by seeking the normalization factor per spectrum, efficient, reversible compression operation is possible which utilizes a high correlation existing in normalization factors of mutually adjacent spectra, therefore, by comparison to the case of using the critical band, the information efficiency is not one-sidedly disadvantageous.

Note that the present invention is not limited to the above embodiments described with reference to the drawings. It is apparent to those skilled in the art that various modifications, substitutions or equivalents can be made without departing from the scope of appended claims and the spirit of the present invention.

INDUSTRIAL APPLICABILITY

According to the present invention described above, in the signal encoding apparatus, a weighting factor using the auditory properties when allocating bits by relying on each frequency component value is prepared, and weight information on this weighting factor is encoded together with the normalization factor index and the quantized spectral signal and included in the code string, while in the signal decoding apparatus, using the weighting factor obtained by decoding this code string, the quantization accuracy per frequency component is restored and the noise level at the time of reproduction can be minimized by inversely quantizing the quantized spectral according to the quantization accuracy.

The invention claimed is:

1. A signal encoding apparatus comprising:

a spectral transformation unit that transforms an input time domain audio signal per preset unit time to a frequency domain spectral signal;

a normalization unit that receives the frequency domain spectral signal from the spectral transformation unit and (a) generates a plurality of normalized spectral signals by selecting a like plurality of normalization factors having a preset step width with respect to each of a plurality of spectral signal bands and normalizing the spectral signal through use of a selected normalization factor, and (b) generates a normalization factor index by converting the normalization factor per normalized spectrum;

a range conversion unit that receives the normalized spectral signals from the normalization unit and converts the amplitude range of the normalized spectral signals to generate range-converted spectral signals;

a quantization accuracy determining unit that receives the range-converted spectral signals from the range conversion unit and adds a weighting factor per range-converted spectral signal to a normalization factor index used for the normalization and determining quantization accuracy of each normalized spectral signal based on the result of addition;

a quantization unit that quantizes each normalized spectral signal according to the quantization accuracy determined by the quantization accuracy determining means to generate a quantized spectral signal; and an encoder that generates code strings by encoding each quantized spectral signal, the normalization factor index, and weight information on the weighting factor, wherein, the spectral transformation unit is in direct communication with the encoding to supply information regarding the number of spectral signals generated to the encoding means, the normalization unit is in direct communication with the encoding means and the quantization accuracy determining means to supply information regarding the normalization factor index to the encoding means and the quantization accuracy, and the quantization accuracy determining unit is in direct communication with the encoding means to supply said weight information on the weighting factor to the encoding means.

2. The signal encoding apparatus according to claim 1, wherein the quantization accuracy determining unit determines the weighting factor based on the characteristics of the audio signal or the spectral signal.

3. The signal encoding apparatus according to claim 2, wherein the quantization accuracy determining unit has a plurality of weighting factor tables in which the weighting factors are made into a table, the weighting factor is determined by selecting any of the plurality of weighting factor tables based on the characteristics of the audio signal or the spectral signal, and the encoder encodes an index of a selected weighting factor table.

4. The signal encoding apparatus according to claim 2, wherein the quantization accuracy determining unit has a plurality of modeling equations to determine the weighting factor per spectral signal, selects any of the plurality of the modeling equations based on the characteristics of the audio signal or the spectral signal and determines the weighting factor by determining a parameter of the selected modeling equation, and the encoder encodes the index of the selected modeling equation and the parameter of the modeling equation.

5. The signal encoding apparatus according to claim 1, wherein the quantization accuracy determining unit determines accuracy of each normalized spectral signal such that the quantization accuracy with respect to the spectral signal, which makes the result of addition maximum, may become the maximum quantization accuracy in the standard, and the quantization accuracy of each normalized spectral signal may be reduced so as to decrease a total number of bits used below a total number of usable bits if the total number of bits used exceeds the total usable number of bits as a result of encoding through the encoder.

6. The signal encoding apparatus according to claim 1, wherein as the normalization factor index increases or decreases by 1, the quantization accuracy increases or decreases by 1 bit.

7. The signal encoding apparatus according to claim 1, wherein the normalization factor has a step width double at a time, and the normalization unit normalizes each spectral signal value over a range of ±0.5 to ±1.0 by using the normalization factor which is larger than each spectral signal value and closest to each spectral signal value.

8. The signal encoding apparatus according to claim 7, comprising range conversion means for range converting each normalized spectral signal normalized to a range of ±0.5 to ±1.0 to a range of 0 to ±1.0.

9. The signal encoding apparatus according to claim 1, wherein the quantization accuracy determining unit determines the quantization accuracy of each normalized spectral signal such that as a result of encoding through the encoder, the total number of bits used is less than the total usable number of bits to create excess number of bits, adds a new weighting decodable only in a new signal decoding apparatus with respect to the normalization factor index per spectral signal, and determines a new quantization accuracy of each normalized spectral signal based on the result of the addition, and the encoder further encodes, by using the excess number of bits, the quantized spectral signal which was quantized according to the new quantization accuracy and the new weighting factor.

10. A signal encoding method comprising:

a spectral transformation step of transforming an input time domain audio signal to a frequency domain spectral signal for each preset unit time;

a normalization step of selecting any of a plurality of normalization factors having a preset step width with respect to each of a like plurality of spectral signal bands and normalizing the spectral signal by using the selected normalization factor to generate a like plurality of normalized spectral signals;

a range conversion step of converting the amplitude range of the normalized spectral signals to generate range-converted spectral signals;

a quantization accuracy determination step of adding a weighting factor per range-converted spectral signal to the normalization factor index used for the normalization and determining the quantization accuracy of each range-converted spectral signal based on the result of addition;

a quantization step of quantizing each of the range-converted spectral signals according to the quantization accuracy to generate a quantized spectral signal; and an encoding step of generating a code string by at least encoding the quantized spectral signal, the normalization factor index, and weight information relating to the weighting factor, wherein, the code string is generated by an encoder that receives (a) the number of spectral signals, (b) the information regarding the normalization factor index, and (c) the weight information as inputs thereto, and the quantization accuracy determination is made by a unit having the information regarding the normalization factor index as an input thereto.

11. The signal encoding method according to claim 10, wherein in the quantization accuracy determination step, the weighting factor is determined based on the characteristics of the audio signal or the spectral signal.

12. A signal decoding apparatus comprising:

a decoder that decodes an input code string containing a range-converted spectral signals, a quantized spectral signal, a normalization factor index and weight information relating to a weighting factor used in generating the code string;

a quantization accuracy restoring unit in communication with the decoder, the quantization accuracy restoring unit receiving from the decoder the range-converted spectral signals, information on the number of decoded spectra, the normalization information and the weight information as well as maximum quantization information, the quantization accuracy unit adding the weighting factor determined from the weight information per decoded spectra to the normalization factor index to restore the quantization accuracy of range-converted spectral signals based on the result of the addition;

an inverse quantization unit in communication with the decoder and the quantization accuracy restoring unit, the inverse quantization unit receiving from the decoder the information on the number of decoded spectra and the quantization spectrum, the inverse quantization unit receiving from the quantization accuracy restoration unite the range-converted spectral signals, the inverse quantization unit restoring the range-converted spectral signals by inversely quantizing the quantized spectral signal according to the quantization accuracy of each of the range-converted spectral signals;

an inverse range conversion unit in communication with the inverse quantization unit and the decoder, the inverse range conversion unit receiving the inversed quantized spectral signals from the inverse quantization unit and the normalization factor index from the decoder, the inverse range conversion unit converting the range-converted spectral signals into normalized spectral signals;

an inverse normalization unit in communication with the decoder and the inverse range conversion unit, the inverse normalization unit receiving from the decoder the information on the number of decoded spectra and the normalization information, the inverse normalization unit receiving from the inverse range conversion unit the normalized spectral signals, the inverse normalization unit restoring spectral signals by inversely normalizing each of the normalized spectral signals using the normalization factor; and an inverse spectral conversion unit in communication with the inverse normalization unit, the inverse spectral conversion unit receiving the normalized spectral signals from the inverse normalization unit and restoring an audio signal per preset unit time by converting the spectral signals.

13. The signal decoding apparatus according to claim 12, wherein as the normalization factor index increases or decreases by 1, the quantization accuracy increases or decreases by 1.

14. The signal decoding apparatus according to claim 12, wherein:

the normalization factor index has a step width double at a time, in the normalization, a normalization factor which is larger than each spectral signal value and closest to each spectral signal value was used to normalize each spectral signal value over a range from ±0.5 to ±1.0, while each normalized spectral signal normalized over this range from ±0.5 to ±1.0 was subjected to range conversion over the range from 0 to ±1.0, and the inverse range conversion unit restores each normalized spectral signal value which was subjected to range conversion in the range from 0 to ±1.00, to the range from ±0.5 to ±1.0.

15. A signal decoding method comprising:

a decoding step in which a decoder decodes an input code string containing a quantized spectral signal, a normalization factor index and weight information relating to a weighting factor used in generating the code string;

a quantization accuracy restoring step in which information on the number of decoded spectra, the normalization information and the weight information as well as maximum quantization information are communicated to a quantization accuracy restoring unit from the decoder, and the quantization accuracy unit adds the weighting factor determined from the weight information per decoded spectra to the normalization factor index to restore the quantization accuracy of range-converted spectral signals based on the result of the addition;

an inverse quantization step in which the information on the number of decoded spectra and the quantized signal are communicated to a inverse quantization unit from the decoder and the quantization accuracy restoring unit, respectively, and the inverse quantization unit restores the range-converted spectral signals by inversely quantizing the quantized spectral signal according to the quantization accuracy of each of the range-converted spectral signals;

an inverse range conversion step in which the normalizing factor index and the restored range-converted spectral signals are communicated to an inverse quantization unit from the decoder and the inversion quantization unit, respectively, and the range-converted spectral signals are converted into normalized spectral signals by the inverse range conversion unit;

an inverse normalization step in which an inverse normalization unit receives from the decoder the information on the number of decoded spectra and the normalization information, receives the normalized spectral signals from inverse range-conversion unit, and restores a spectral signals by inversely normalizing each of the normalized spectral signals using the normalization factor; and an inverse spectral conversion step in which an inverse spectral conversion unit receives the spectral signals from the inverse normalization unit and restores an audio signal per preset unit time by converting the spectral signals.

* * * * *